US011118253B2

(12) United States Patent
Redmond et al.

(10) Patent No.: US 11,118,253 B2
(45) Date of Patent: Sep. 14, 2021

(54) REACTIVE QUENCHING SOLUTIONS AND METHODS OF USE

(71) Applicant: Novelis Inc., Atlanta, GA (US)

(72) Inventors: Peter L. Redmond, Acworth, GA (US); Theresa Elizabeth MacFarlane, Woodstock, GA (US); ChangOok Son, Marietta, GA (US); Liangliang Li, Atlanta, GA (US); Amanda Owens, Marietta, GA (US); Kevin Mark Johnson, Woodstock, GA (US)

(73) Assignee: NOVELIS INC., Atlanta, GA (US)

( * ) Notice: Subject to any disclaimer, the term of this patent is extended or adjusted under 35 U.S.C. 154(b) by 219 days.

(21) Appl. No.: 16/167,929

(22) Filed: Oct. 23, 2018

(65) Prior Publication Data

US 2019/0119798 A1 Apr. 25, 2019

Related U.S. Application Data

(60) Provisional application No. 62/575,611, filed on Oct. 23, 2017.

(51) Int. Cl.
*C21D 1/60* (2006.01)
*C22F 1/04* (2006.01)
(Continued)

(52) U.S. Cl.
CPC ..... *C22F 1/002* (2013.01); *C21D 1/60* (2013.01); *C22F 1/04* (2013.01)

(58) Field of Classification Search
CPC . C22F 1/04–057; C21D 1/60; C21D 1/62–64; C21D 1/68–72
(Continued)

(56) References Cited

U.S. PATENT DOCUMENTS 3,022,205 A 2/1962 Chase et al.
3,224,910 A 12/1965 Malcolm
(Continued)

FOREIGN PATENT DOCUMENTS

CN 105951009 * 9/2016 ..... C22C 21/16
EP 2940157 11/2015
(Continued)

OTHER PUBLICATIONS

Cui , "The Effect of Dissolving Salts or Gases in Water Sprayed on a Hot Surface", University of Toronto, Toronto (2001).
(Continued)

*Primary Examiner* — Lois L Zheng
(74) *Attorney, Agent, or Firm* — Kilpatrick Townsend & Stockton LLP

(57) ABSTRACT

Described are techniques for treating metals by exposing the metals to reactive solutions to reduce a temperature of the metal and to modify a surface of the metal through chemical reaction, such as by removing material or adding material. The disclosed techniques may advantageously increase the rate at which the temperature of the metal may be reduced as compared to conventional cooling techniques involving pure water, increase metal manufacturing rates, and reduce overall complexity of a metal manufacturing process. The disclosed techniques may also advantageously expand the range of available surface treatments, allow for faster surface treatment processes, and reduce or eliminate the use of hazardous chemicals during a surface treatment process. Such advantages may arise by employing chemical processing that takes place or takes place more efficiently at elevated temperatures.

18 Claims, 15 Drawing Sheets

(51) Int. Cl.
*C22F 1/00* (2006.01)
*C23C 22/00* (2006.01)

(58) Field of Classification Search
USPC ..... 148/637–638
See application file for complete search history.

(56) References Cited

U.S. PATENT DOCUMENTS

| | | | | |
|---|---|---|---|---|
| 3,475,232 | A | 10/1969 | Lewis et al. | |
| 3,865,642 | A | 2/1975 | Foreman | |
| 7,472,740 | B2 | 1/2009 | Anderson et al. | |
| 7,748,434 | B2 | 7/2010 | Wagstaff | |
| 7,771,548 | B2 * | 8/2010 | Cockcroft | C09D 133/26 148/559 |
| 8,927,113 | B2 | 1/2015 | Anderson et al. | |
| 2013/0001461 | A1 | 1/2013 | Ichitani et al. | |

FOREIGN PATENT DOCUMENTS

| | | |
|---|---|---|
| JP | S6442521 | 2/1989 |
| JP | H10317112 | 12/1998 |
| JP | H11117047 | 4/1999 |
| JP | 2005530047 | 10/2005 |
| JP | 2008297630 | 12/2008 |
| JP | 2009007617 | 1/2009 |
| JP | 2010031350 | 2/2010 |
| JP | 2010222659 | 10/2010 |
| JP | 2011058077 | 3/2011 |
| JP | 2011168860 | 9/2011 |
| JP | 2012012638 | 1/2012 |
| JP | 2012031479 | 2/2012 |
| JP | 5023232 | 9/2012 |
| JP | 2013166975 | 8/2013 |
| JP | 2014062277 | 4/2014 |
| JP | 2015221924 | 12/2015 |
| JP | 2017155289 | 9/2017 |

OTHER PUBLICATIONS

International Application No. PCT/US2018/057060 , "International Search Report and Written Opinion", dated Jan. 18, 2019, 11 pages.
Japanese Application No. 2020-520004, Office Action, dated Feb. 2, 2021, 18 pages.
Canadian Patent Application No. 3,084,467 , Office Action dated May 20, 2021, 3 pages.
Chinese Patent Application No. 201880068813.0 , Office Action dated Apr. 13, 2021, 22 pages.
Indian Patent Application No. 202017016037 , First Examination Report dated May 8, 2021, 7 pages.

* cited by examiner

REACTIVE QUENCHING SOLUTIONS AND METHODS OF USE

CROSS-REFERENCE TO RELATED APPLICATION

This application claims the benefit of and priority to U.S. Provisional Application No. 62/575,611, filed on Oct. 23, 2018, which is hereby incorporated by reference in its entirety.

FIELD

The present disclosure relates to metallurgy generally and more specifically to techniques for treating metal surfaces during manufacturing.

BACKGROUND

A variety of techniques exist for treating aluminum surfaces, such as surface anodization, electroplating, powder coating, painting, printing, and silkscreening processes, as well as mechanical surface treatments like embossing and polishing. These processes generally require pre-treatment to prepare the surfaces. Additionally, these processes may not be suitable for use during the aluminum manufacturing processes, where high temperatures, such as those approaching the melting or solidus temperature of aluminum or an aluminum alloy, may be encountered.

SUMMARY

This specification relates to and describes techniques for treating a metal, such as during manufacturing or fabrication, and treated metals formed thereby. The disclosed techniques provide for the ability to add material to the surface of a metal or remove material from the surface of a metal in a controlled fashion while simultaneously cooling the metal from an elevated temperature in a controlled way, such as from close to the melting or solidus temperature of the metal or alloy comprising the metal, to a lower temperature, such as room temperature, for example. The cooling process may be referred to herein as "quenching" and may correspond to a process by which a temperature of the metal is changed at a high rate, such as decreased at a cooling rate greater than may be achieved through use of pure water. In embodiments, the disclosed techniques make use of a process where a heated metal is exposed to a solution including one or more reactive solutes. The heated metal may be cooled by exposure to the solution and the one or more reactive solutes may initiate or participate in a modification of the surface of the metal, such as a chemical reaction that modifies the surface of the metal. As an example, a heated metal may be exposed an aqueous solution including a reactive dissolved species or a reactive suspended species, whereby the temperature of the metal is reduced and also the surface of the metal undergoes treatment by adding material to the surface or removing material from the surface. In some embodiments, a reactive dissolved species may correspond to a solute composition that may react by itself, or with another composition, to modify the surface of the metal, and that have a maximum solubility in a solvent, such as water, of over 0.5 wt. %, such as a solubility of from 0.5 wt. % to 50 wt. %, from 1 wt. % to 45 wt. %, from 5 wt. % to 40 wt. %, from 10 wt. % to 35 wt. %, from 0.5 wt. % to 1 wt. %, from 1 wt. % to 2 wt. %, from 2 wt. % to 5 wt. %, from 5 wt. % to 10 wt. %, from 10 wt. % to 15 wt. %, from 15 wt. % to 20 wt. %, from 20 wt. % to 25 wt. %, from 25 wt. % to 30 wt. %, from 30 wt. % to 35 wt. %, from 35 wt. % to 40 wt. %, from 40 wt. % to 45 wt. %, or from 45 wt. % to 50 wt. %. In some embodiments, a reactive suspended species may correspond to a composition that may react by itself, or with another composition, to modify the surface of the metal, and that may be insoluble in a solvent, such as water, and/or comprise suspended particles or groups of molecules or atoms in the solvent, such as a colloidal solution or other suspension.

In some examples, a method of treating a metal comprises heating the metal to a first temperature; and exposing the metal to a solution including a reactive solute, such as where exposing the metal to the solution cools the metal at a cooling rate of from about 100° C./s to about 10000° C./s, such as from about 300° C./s to about 2000° C./s, and where exposing the metal to the solution initiates a modification of a surface of the metal, such as a chemical reaction involving reactive solute present in the solution, for example, a chemical reaction that modifies a surface of the metal. In some embodiments, the reactive solute is not water or is other than water. In some embodiments, water does not participate in the chemical reaction as a reactant. Optionally, the reactive solute is not a hydroxide salt or hydroxide ion or is other than a hydroxide salt or hydroxide ion. Optionally, hydroxide ions do not participate in the chemical reaction as a reactant. Optionally, the chemical reaction corresponds to an acid etching reaction, an alkaline etching reaction, a thermal decomposition reaction, a polymerization reaction, an oxidative reaction, or a surface ablation. Optionally, the solution may be referred to as a quench solution. Optionally, the solution is a liquid solution. Optionally the solution is a gas-phase solution (i.e., a mixture of different gases).

Various quenching configurations are useful with the methods described herein. For example, exposing the metal to the solution optionally comprises immersing the metal in the solution or spraying the solution on or towards the surface of the metal. As another example, exposing the metal to the solution optionally comprises exposing the metal to a plurality of different solutions. Exposing the metal to the solution optionally results in cooling the metal to a series of increasingly lower temperatures. In some embodiments, exposing the metal to the solution comprises cooling the metal to a second temperature. Optionally, the method may further comprise exposing the metal to a second solution, such that exposing the metal to the second solution cools the metal from the second temperature and initiates a second chemical reaction that further modifies the surface of the metal. Optionally, exposing the metal to the second solution cools the metal at a second cooling rate from about 50° C./s to about 500° C./s.

Optionally, the solution is a 100% reactive component and the reactive component can be used to both quench and react with or at the surface of the metal. For example, the metal may be exposed to a reactive monomer that is not dissolved in a solvent and the reactive monomer both cools the metal and undergoes thermally induced polymerization or cross-linking reaction to deposit polymerized or cross-linked material on the surface of the metal. Such a configuration may optionally be useful as the second quench stage of a two-stage quenching process.

A variety of temperature characteristics are useful with the methods described herein. For example, exposing the metal to the solution may cool the metal to a temperature between 25° C. and 500° C. Optionally, the first temperature is less than a melting or solidus temperature of the metal or alloy comprising the metal. Optionally, the first temperature is greater than or equal to a melting or solidus temperature of the metal or alloy. In some embodiments, the first temperature corresponds to a solution heat-treatment temperature. In some embodiments, heating the metal corresponds to solution heat-treating the metal. Optionally, the metal may be further heat-treated by holding the metal at the first temperature for a period of time. In embodiments, the first temperature is from about 500° C. to about 1500° C.

A variety of metals and metal products are useful with the methods described herein. For example, useful metals include those comprising aluminum or an aluminum alloy, magnesium or a magnesium alloy, or steel. Useful metal may comprise metal alloys, such as metals comprising one or more elements selected from the group consisting of copper, manganese, magnesium, zinc, silicon, iron, chromium, tin, zirconium, lithium, and titanium. Useful metals include those comprising a homogeneous alloy, a monolithic alloy, a metal alloy solid solution, a heterogeneous alloy, an intermetallic alloy, or a cladded alloy or clad layer.

Optionally, the solution comprises water and one or more salts, i.e., an aqueous salt solution. Inclusion of salts in an aqueous solution may allow for tuning or optimizing the quench rate or cooling rate at which a metal may be cooled from a temperature above a boiling point of the aqueous solution. In some examples, the solution comprises one or more alkali metal salts, alkaline earth metal salts, ammonium salts, sulfate salts, nitrate salts, borate salts, phosphate salts, acetate salts, or carbonate salts. In some examples, one of the one or more salts in the solution is the reactive solute. Optionally, the solution comprises a salt concentration of from about 5 wt. % salt to about 30 wt. % salt. Optionally, the solution comprises a saturated or supersaturated salt solution. In embodiments, some salts may not react with a metal surface or may only react with a metal surface at a limited or insubstantial rate, such as at a rate that does not substantially modify a surface of the metal, a rate that does not result in a recognizable change to the surface of the metal, or at a rate that is otherwise considered non-reactive. Through exposure to elevated temperatures, such as temperatures generated by exposing the solution to a heated metal, a rate of reaction involving the salt may be increased as compared to a rate of reaction involving the salt at room temperature, for example.

It may be advantageous, in some cases, to limit the salt or ions present in a solution, as certain ionic species may react undesirably with some metals or become undesirably incorporated in the body or surface of a metal or metal product. In some examples, the solution lacks or does not include (i.e., excludes) halide ions. Optionally, a concentration of halide ions in the solution is very low, such as between 0 wt. % and 0.001 wt. %.

Optionally, the solution comprises a gas-phase solution of one or more reactive gases and one or more non-reactive gases. In some cases, the one or more reactive gases may be a solute in a solvent that is the one or more non-reactive gases. For example, in some embodiments, the reactive gas may be one or more of hydrogen, ammonia, oxygen, hydrogen sulfide, hydrogen cyanide, sulfur dioxide, nitric oxide, nitrogen dioxide, or silane. In some embodiments, the non-reactive gas may be one or more of helium, nitrogen, or argon.

In some examples, the solution may be an etching or surface cleaning solution or cause an etching or surface cleaning reaction upon contact with a metal surface. For example, the chemical reaction may optionally remove material from the surface of the metal. Optionally, the chemical reaction corresponds to cleaning, etching, or ablating the surface of the metal. In examples, the solution optionally comprises an aqueous alkaline solution. Useful solutions may comprise one or more of sodium hydroxide, potassium hydroxide, ammonia, or ammonium ions. Optionally, the solution comprises an aqueous acidic solution. Useful solutions may comprise one or more of sulfuric acid, nitric acid, phosphoric acid, boric acid, or an organic acid, such as a sulfonic acid or a carboxylic acid.

In some examples, the solution may be useful for coating or depositing material onto a metal surface. For example, the chemical reaction may optionally deposit material on the surface of the metal or form a coating on the surface of the metal. As an example, decomposition of a thermally decomposable salt may allow for depositing a component of the salt onto a metal surface. Accordingly, useful solutions include those comprising a thermally decomposable salt. As examples, the solution may optionally comprise one or more nitrate salts, nitrite salts, carbonate salts, hydrogen carbonate salts, phosphate salts, hydrogen phosphate salts, dihydrogen phosphate salts, or permanganate salts. Example solutions may comprise one or more chromium (III) salts, copper (II) salts, silver (I) salts, or cerium salts. Other example solutions may comprise one or more polymers, polymer precursors, or thermoset polymers, which may optionally deposit polymeric films on the surface of the metal.

Other additives may be included in the solution. For example, in some embodiments, the solution comprises insoluble particles. Optionally, exposing the metal to the solution compresses outer layers of the surface to form a compacted surface. Optionally, exposing the metal to the solution erodes material from the surface to form an eroded surface.

A variety of techniques may be used to control aspects of the disclosed techniques. For example, process variables or parameters may be selected and established to control a reaction rate or a cooling rate. Optionally, a temperature of the solution is a useful process parameter that may optionally be selected and established to control the cooling rate and/or reaction rate. For example, a temperature of the solution prior to exposure to the metal may be actively adjusted, such as by adding or removing heat from the solution, to establish a particular temperature. Optionally, the solution has a temperature of between 0° C. and 50° C. A flow rate of the solution is a useful process parameter that may optionally be selected and established to control the cooling rate and/or reaction rate. A pressure of the solution is a useful process parameter that may optionally be selected and established to control the cooling rate and/or reaction rate. A spray angle, spray direction, spray geometry of the solution are useful process parameters that may optionally be selected and established to control the cooling rate and/or reaction rate. An exposure time of the metal to the solution is a useful process parameter that may optionally be selected and established to control the cooling rate and/or reaction rate. A concentration of a reactive solute is a useful process parameter that may optionally be selected and established to control the cooling rate and/or reaction rate.

One or more post-quenching treatments may be useful with the methods described herein. For example, in some embodiments, a method may further comprise washing the surface of the metal with water after exposing the metal to the solution. Optionally, a method further comprises anodizing the surface, powder coating the surface, or painting or printing on the surface.

Also provided herein are treated metals, such as treated metal products, comprising a metal heated to a first temperature and exposed to a solution that cools the metal at a cooling rate of from about 100° C./s to about 10000° C./s, such as from about 300° C./s to about 2000° C./s, and initiates a chemical reaction that modifies a surface of the metal. Optionally, the chemical reaction that modifies the surface of the metal corresponds to a cleaning reaction, an etching reaction, an ablating reaction, a coating reaction, or a deposition reaction. Optionally, the surface of the metal is cleaned, etched, ablated, coated, or deposited upon during the chemical reaction.

The term embodiment and like terms are intended to refer broadly to all of the subject matter of this disclosure and the claims below. Statements containing these terms should be understood not to limit the subject matter described herein or to limit the meaning or scope of the claims below. Embodiments of the present disclosure covered herein are defined by the claims below, not this summary. This summary is a high-level overview of various aspects of the disclosure and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this disclosure, any or all drawings, and each claim.

Other objects and advantages will be apparent from the following detailed description of non-limiting examples.

BRIEF DESCRIPTION OF THE FIGURES

The specification makes reference to the following appended figures, in which use of like reference numerals in different figures is intended to illustrate like or analogous components.

DETAILED DESCRIPTION

Figure 1:
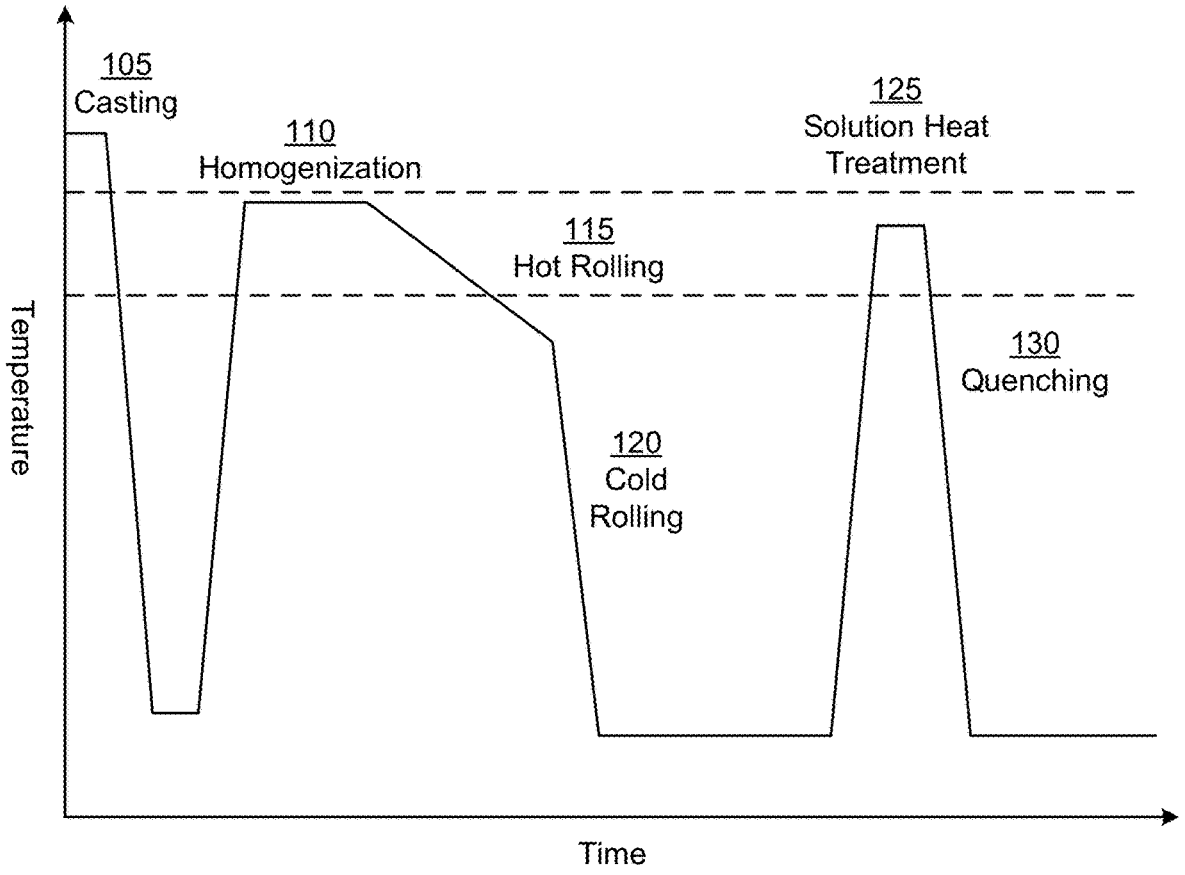
FIG. 1 is a plot showing metal temperature as a function of time during various stages of a manufacturing process.

Described herein are techniques for treating metals by exposing the metals to aqueous salt solutions to reduce a temperature of the metal and to modify a surface of the metal by removing material or adding material. The disclosed techniques may advantageously increase the rate at which the temperature of the metal may be reduced as compared to conventional cooling techniques involving pure water, increase metal manufacturing rates, and reduce overall complexity of a metal manufacturing process. The disclosed techniques may also advantageously expand the range of available surface treatments, allow for faster surface treatment processes, and reduce or eliminate the use of hazardous chemicals during a surface treatment process. Such advantages may arise by employing chemical processing that takes place or takes place more efficiently at elevated temperatures or by using decomposable surface treatment precursors, for example.

Definitions and Descriptions

As used herein, the terms "invention," "the invention," "this invention" and "the present invention" are intended to refer broadly to all of the subject matter of this patent application and the claims below. Statements containing these terms should be understood not to limit the subject matter described herein or to limit the meaning or scope of the patent claims below.

In this description, reference is made to alloys identified by AA numbers and other related designations, such as "series" or "7xxx." For an understanding of the number designation system most commonly used in naming and identifying aluminum and its alloys, see "International Alloy Designations and Chemical Composition Limits for Wrought Aluminum and Wrought Aluminum Alloys" or "Registration Record of Aluminum Association Alloy Designations and Chemical Compositions Limits for Aluminum Alloys in the Form of Castings and Ingot," both published by The Aluminum Association and incorporated herein by reference.

As used herein, a plate generally has a thickness of greater than about 15 mm. For example, a plate may refer to an aluminum product having a thickness of greater than about 15 mm, greater than about 20 mm, greater than about 25 mm, greater than about 30 mm, greater than about 35 mm, greater than about 40 mm, greater than about 45 mm, greater than about 50 mm, or greater than about 100 mm.

As used herein, a shate (also referred to as a sheet plate) generally has a thickness of from about 4 mm to about 15 mm. For example, a shate may have a thickness of about 4 mm, about 5 mm, about 6 mm, about 7 mm, about 8 mm, about 9 mm, about 10 mm, about 11 mm, about 12 mm, about 13 mm, about 14 mm, or about 15 mm.

As used herein, a sheet generally refers to an aluminum product having a thickness of less than about 4 mm. For example, a sheet may have a thickness of less than about 4 mm, less than about 3 mm, less than about 2 mm, less than about 1 mm, less than about 0.5 mm, or less than about 0.3 mm (e.g., about 0.2 mm).

Reference may be made in this application to alloy temper or condition. For an understanding of the alloy temper descriptions most commonly used, see "American National Standards (ANSI) H35 on Alloy and Temper Designation Systems." An F condition or temper refers to an aluminum alloy as fabricated. An O condition or temper refers to an aluminum alloy after annealing. An Hxx condition or temper, also referred to herein as an H temper, refers to a non-heat treatable aluminum alloy after cold rolling with or without thermal treatment (e.g., annealing). Suitable H tempers include HX1, HX2, HX3 HX4, HX5, HX6, HX7, HX8, or HX9 tempers. A T1 condition or temper refers to an aluminum alloy cooled from hot working and naturally aged (e.g., at room temperature). A T2 condition or temper refers to an aluminum alloy cooled from hot working, cold worked and naturally aged. A T3 condition or temper refers to an aluminum alloy solution heat treated, cold worked, and naturally aged. A T4 condition or temper refers to an aluminum alloy solution heat treated and naturally aged. A T5 condition or temper refers to an aluminum alloy cooled from hot working and artificially aged (at elevated temperatures). A T6 condition or temper refers to an aluminum alloy solution heat treated and artificially aged. A T7 condition or temper refers to an aluminum alloy solution heat treated and artificially overaged. A T8x condition or temper refers to an aluminum alloy solution heat treated, cold worked, and artificially aged. A T9 condition or temper refers to an aluminum alloy solution heat treated, artificially aged, and cold worked. A W condition or temper refers to an aluminum alloy after solution heat treatment.

As used herein, terms such as "cast metal product," "cast product," "cast aluminum alloy product," and the like are interchangeable and refer to a product produced by direct chill casting (including direct chill co-casting) or semi-continuous casting, continuous casting (including, for example, by use of a twin belt caster, a twin roll caster, a block caster, or any other continuous caster), electromagnetic casting, hot top casting, or any other casting method.

A metal may optionally correspond to a metal product. A metal may optionally be a cast metal product, an intermediate metal product, a rolled metal product, a formed metal product, or a finished metal product, for example. Example metal products include metal sheets, metal shates, or metal plates. In embodiments, a metal product may be a homogenized metal product, a heat treated metal product, a partially rolled metal product, an annealed metal product, a pre-treated metal product. Metals and metal products can be subjected to additional processing following the reactive quenching processes described herein.

As used herein, the meaning of "room temperature" can include a temperature of from about 15° C. to about 30° C., for example about 15° C., about 16° C., about 17° C., about 18° C., about 19° C., about 20° C., about 21° C., about 22° C., about 23° C., about 24° C., about 25° C., about 26° C., about 27° C., about 28° C., about 29° C., or about 30° C. As used herein, the meaning of "ambient conditions" can include temperatures of about room temperature, relative humidity of from about 20% to about 100%, and barometric pressure of from about 975 millibar (mbar) to about 1050 mbar. For example, relative humidity can be about 20%, about 21%, about 22%, about 23%, about 24%, about 25%, about 26%, about 27%, about 28%, about 29%, about 30%, about 31%, about 32%, about 33%, about 34%, about 35%, about 36%, about 37%, about 38%, about 39%, about 40%, about 41%, about 42%, about 43%, about 44%, about 45%, about 46%, about 47%, about 48%, about 49%, about 50%, about 51%, about 52%, about 53%, about 54%, about 55%, about 56%, about 57%, about 58%, about 59%, about 60%, about 61%, about 62%, about 63%, about 64%, about 65%, about 66%, about 67%, about 68%, about 69%, about 70%, about 71%, about 72%, about 73%, about 74%, about 75%, about 76%, about 77%, about 78%, about 79%, about 80%, about 81%, about 82%, about 83%, about 84%, about 85%, about 86%, about 87%, about 88%, about 89%, about 90%, about 91%, about 92%, about 93%, about 94%, about 95%, about 96%, about 97%, about 98%, about 99%, about 100%, or anywhere in between. For example, barometric pressure can be about 975 mbar, about 980 mbar, about 985 mbar, about 990 mbar, about 995 mbar, about 1000 mbar, about 1005 mbar, about 1010 mbar, about 1015 mbar, about 1020 mbar, about 1025 mbar, about 1030 mbar, about 1035 mbar, about 1040 mbar, about 1045 mbar, about 1050 mbar, or anywhere in between.

All ranges disclosed herein are to be understood to encompass any and all subranges subsumed therein. For example, a stated range of "1 to 10" should be considered to include any and all subranges between (and inclusive of) the minimum value of 1 and the maximum value of 10; that is, all subranges beginning with a minimum value of 1 or more, e.g. 1 to 6.1, and ending with a maximum value of 10 or less, e.g., 5.5 to 10. Unless stated otherwise, the expression "up to" when referring to the compositional amount of an element means that element is optional and includes a zero percent composition of that particular element. Unless stated otherwise, all compositional percentages are in weight percent (wt. %).

As used herein, the meaning of "a," "an," and "the" includes singular and plural references unless the context clearly dictates otherwise.

As used herein, the term "surface" refers to an outermost region of an object, such as a metal sheet, shate, plate, ingot, or other metal or metal product, such as a cast metal product. In embodiments, a surface may correspond to a transitional region or layer of an object representing a termination of the object and transition to another substance, such as air or water, or, when present in a vacuum, no substance. Surfaces may correspond to a two-dimensional area of an object at the outermost periphery of the object. In embodiments where a surface represents a transitional region or layer of an object, the transitional region or layer may have a thickness, such as a thickness corresponding to a layer of atoms or molecules representing the termination of the body of the object and, in some embodiments, adjacent layers of atoms or molecules below the terminating layer that are exposed to or otherwise susceptible to another substance beyond the terminating layer, such as air or water or dissolved components thereof. Surfaces may correspond to those layers or thicknesses of an outer portion of an object that may undergo chemical reaction when exposed to a solution containing reactants that may react with the material of the object. As one example, a surface of an aluminum object or alloy may correspond to an outer layer that undergoes oxidation upon exposure to air, forming an aluminum oxide layer. As another example, a surface of metal object may correspond to that region of the metal object that may be coated by or in contact with another substance, such as paint, a thin film, or another coating material. As examples, a surface may extend from the exterior surface of the object into an interior of the object to a depth of up to 5 μm, but generally much less. For example, the surface can refer to the portion of the object that extends into the interior of the object from (and including) the exterior surface to a depth of 0.01 μm, 0.05 μm, 0.10 μm, 0.15 μm, 0.20 μm, 0.25 μm, 0.3 μm, 0.35 μm, 0.4 μm, 0.45 μm, 0.50 μm, 0.55 μm, 0.60 μm, 0.65 μm, 0.70 μm, 0.75 μm, 0.80 μm, 0.85 μm, 0.9 μm, 0.95 μm, 1.0 μm, 1.5 μm, 2.0 μm, 2.5 μm, 3.0 μm, 3.5 μm, 4.0 μm, 4.5 μm, or 5.0 μm, or anywhere in between. In some embodiments, the surface extends from the external surface to a depth ranging from 100 nm to 200 nm within the interior of the object. In some further such embodiments, the subsurface extends from the external surface to a depth of 100 nm, 110 nm, 120, nm, 130 nm, 140 nm, 150 nm, 160 nm, 170 nm, 180 nm, 190 nm, or 200 nm within the interior of the object. The portion of the object excluding the surface portion (e.g., the remainder of the object) is referred to herein as the "bulk" or "bulk portion" of the object. Note that, for a metal object (e.g., a metal product) having two rolled surfaces, such as with an aluminum alloy sheet or shate, the object can have two surface portions with a bulk portion lying between them.

In the following examples, the aluminum alloy products and their components may described in terms of their elemental composition in weight percent (wt. %) or in terms of a particular alloy or alloy series. In each alloy, the remainder is aluminum, with a maximum wt. % of 0.15% for the sum of all impurities.

Incidental elements, such as grain refiners and deoxidizers, or other additives may be present in an alloy and may add other characteristics on their own without departing from or significantly altering the alloy described herein or the characteristics of the alloy described herein.

A clad layer as described herein can be attached to a core or other metal layer as described herein to form a cladded product or cladded alloy by any suitable means. For example, a clad layer can be attached to a core layer by direct chill co-casting (i.e., fusion casting) as described in, for example, U.S. Pat. Nos. 7,748,434 and 8,927,113, both of which are hereby incorporated by reference in their entireties; by hot and cold rolling a composite cast ingot as described in U.S. Pat. No. 7,472,740, which is hereby incorporated by reference in its entirety; or by roll bonding to achieve a metallurgical bond between the core and the cladding. The initial dimensions and final dimensions of the cladded alloy products described herein can be determined by the desired properties of the overall final product.

The roll bonding process can be carried out in different manners, using any suitable techniques. For example, the roll bonding process can include both hot rolling and cold rolling. Further, the roll bonding process can be a one-step process or a multi-step process in which the material is gauged down during successive rolling steps. Separate rolling steps can optionally be separated by other processing steps, including, for example, annealing steps, cleaning steps, heating steps, cooling steps, and the like.

Methods of Treating Metal Alloys

Described herein are methods of treating metals, such as alloys, including aluminum, aluminum alloys, magnesium, magnesium alloys, magnesium composites, and steel, among others, and the resultant treated metals and metal alloys. In some examples, the metals for use in the methods described herein include aluminum alloys, for example, 1xxx series aluminum alloys, 2xxx series aluminum alloys, 3xxx series aluminum alloys, 4xxx series aluminum alloys, 5xxx series aluminum alloys, 6xxx series aluminum alloys, 7xxx series aluminum alloys, or 8xxx series aluminum alloys. In some examples, the materials for use in the methods described herein include non-ferrous materials, including aluminum, aluminum alloys, magnesium, magnesium-based materials, magnesium alloys, magnesium composites, titanium, titanium-based materials, titanium alloys, copper, copper-based materials, composites, sheets used in composites, or any other suitable metal, non-metal or combination of materials. Monolithic as well as non-monolithic, such as roll-bonded materials, cladded alloys, clad layers, composite materials, such as but not limited to carbon fiber-containing materials, or various other materials are also useful with the methods described herein. In some examples, aluminum alloys containing iron are useful with the methods described herein.

By way of non-limiting example, exemplary 1xxx series aluminum alloys for use in the methods described herein can include AA1100, AA1100A, AA1200, AA1200A, AA1300, AA1110, AA1120, AA1230, AA1230A, AA1235, AA1435, AA1145, AA1345, AA1445, AA1150, AA1350, AA1350A, AA1450, AA1370, AA1275, AA1185, AA1285, AA1385, AA1188, AA1190, AA1290, AA1193, AA1198, and AA1199.

Non-limiting exemplary 2xxx series aluminum alloys for use in the methods described herein can include AA2001, A2002, AA2004, AA2005, AA2006, AA2007, AA2007A, AA2007B, AA2008, AA2009, AA2010, AA2011, AA2011A, AA2111, AA2111A, AA2111B, AA2012, AA2013, AA2014, AA2014A, AA2214, AA2015, AA2016, AA2017, AA2017A, AA2117, AA2018, AA2218, AA2618, AA2618A, AA2219, AA2319, AA2419, AA2519, AA2021, AA2022, AA2023, AA2024, AA2024A, AA2124, AA2224, AA2224A, AA2324, AA2424, AA2524, AA2624, AA2724, AA2824, AA2025, AA2026, AA2027, AA2028, AA2028A, AA2028B, AA2028C, AA2029, AA2030, AA2031, AA2032, AA2034, AA2036, AA2037, AA2038, AA2039, AA2139, AA2040, AA2041, AA2044, AA2045, AA2050, AA2055, AA2056, AA2060, AA2065, AA2070, AA2076, AA2090, AA2091, AA2094, AA2095, AA2195, AA2295, AA2196, AA2296, AA2097, AA2197, AA2297, AA2397, AA2098, AA2198, AA2099, and AA2199.

Non-limiting exemplary 3xxx series aluminum alloys for use in the methods described herein can include AA3002, AA3102, AA3003, AA3103, AA3103A, AA3103B, AA3203, AA3403, AA3004, AA3004A, AA3104, AA3204, AA3304, AA3005, AA3005A, AA3105, AA3105A, AA3105B, AA3007, AA3107, AA3207, AA3207A, AA3307, AA3009, AA3010, AA3110, AA3011, AA3012, AA3012A, AA3013, AA3014, AA3015, AA3016, AA3017, AA3019, AA3020, AA3021, AA3025, AA3026, AA3030, AA3130, and AA3065.

Non-limiting exemplary 4xxx series aluminum alloys for use in the methods described herein can include AA4004, AA4104, AA4006, AA4007, AA4008, AA4009, AA4010, AA4013, AA4014, AA4015, AA4015A, AA4115, AA4016, AA4017, AA4018, AA4019, AA4020, AA4021, AA4026, AA4032, AA4043, AA4043A, AA4143, AA4343, AA4643, AA4943, AA4044, AA4045, AA4145, AA4145A, AA4046, AA4047, AA4047A, and AA4147.

Non-limiting exemplary 5xxx series aluminum alloys for use as the aluminum alloy product can include AA5182, AA5183, AA5005, AA5005A, AA5205, AA5305, AA5505, AA5605, AA5006, AA5106, AA5010, AA5110, AA5110A, AA5210, AA5310, AA5016, AA5017, AA5018, AA5018A, AA5019, AA5019A, AA5119, AA5119A, AA5021, AA5022, AA5023, AA5024, AA5026, AA5027, AA5028, AA5040, AA5140, AA5041, AA5042, AA5043, AA5049, AA5149, AA5249, AA5349, AA5449, AA5449A, AA5050, AA5050A, AA5050C, AA5150, AA5051, AA5051A, AA5151, AA5251, AA5251A, AA5351, AA5451, AA5052, AA5252, AA5352, AA5154, AA5154A, AA5154B, AA5154C, AA5254, AA5354, AA5454, AA5554, AA5654, AA5654A, AA5754, AA5854, AA5954, AA5056, AA5356, AA5356A, AA5456, AA5456A, AA5456B, AA5556, AA5556A, AA5556B, AA5556C, AA5257, AA5457, AA5557, AA5657, AA5058, AA5059, AA5070, AA5180, AA5180A, AA5082, AA5182, AA5083, AA5183, AA5183A, AA5283, AA5283A, AA5283B, AA5383, AA5483, AA5086, AA5186, AA5087, AA5187, and AA5088.

Non-limiting exemplary 6xxx series aluminum alloys for use in the methods described herein can include AA6101, AA6101A, AA6101B, AA6201, AA6201A, AA6401, AA6501, AA6002, AA6003, AA6103, AA6005, AA6005A, AA6005B, AA6005C, AA6105, AA6205, AA6305, AA6006, AA6106, AA6206, AA6306, AA6008, AA6009, AA6010, AA6110, AA6110A, AA6011, AA6111, AA6012, AA6012A, AA6013, AA6113, AA6014, AA6015, AA6016, AA6016A, AA6116, AA6018, AA6019, AA6020, AA6021, AA6022, AA6023, AA6024, AA6025, AA6026, AA6027, AA6028, AA6031, AA6032, AA6033, AA6040, AA6041, AA6042, AA6043, AA6151, AA6351, AA6351A, AA6451, AA6951, AA6053, AA6055, AA6056, AA6156, AA6060, AA6160, AA6260, AA6360, AA6460, AA6460B, AA6560, AA6660, AA6061, AA6061A, AA6261, AA6361, AA6162, AA6262, AA6262A, AA6063, AA6063A, AA6463, AA6463A, AA6763, A6963, AA6064, AA6064A, AA6065, AA6066, AA6068, AA6069, AA6070, AA6081, AA6181, AA6181A, AA6082, AA6082A, AA6182, AA6091, and AA6092.

Non-limiting exemplary 7xxx series aluminum alloys for use in the methods described herein can include AA7011, AA7019, AA7020, AA7021, AA7039, AA7072, AA7075, AA7085, AA7108, AA7108A, AA7015, AA7017, AA7018, AA7019A, AA7024, AA7025, AA7028, AA7030, AA7031, AA7033, AA7035, AA7035A, AA7046, AA7046A, AA7003, AA7004, AA7005, AA7009, AA7010, AA7011, AA7012, AA7014, AA7016, AA7116, AA7122, AA7023, AA7026, AA7029, AA7129, AA7229, AA7032, AA7033, AA7034, AA7036, AA7136, AA7037, AA7040, AA7140, AA7041, AA7049, AA7049A, AA7149, 7204, AA7249, AA7349, AA7449, AA7050, AA7050A, AA7150, AA7250, AA7055, AA7155, AA7255, AA7056, AA7060, AA7064, AA7065, AA7068, AA7168, AA7175, AA7475, AA7076, AA7178, AA7278, AA7278A, AA7081, AA7181, AA7185, AA7090, AA7093, AA7095, and AA7099.

Non-limiting exemplary 8xxx series aluminum alloys for use in the methods described herein can include AA8005, AA8006, AA8007, AA8008, AA8010, AA8011, AA8011A, AA8111, AA8211, AA8112, AA8014, AA8015, AA8016, AA8017, AA8018, AA8019, AA8021, AA8021A, AA8021B, AA8022, AA8023, AA8024, AA8025, AA8026, AA8030, AA8130, AA8040, AA8050, AA8150, AA8076, AA8076A, AA8176, AA8077, AA8177, AA8079, AA8090, AA8091, or AA8093.

The alloys can be produced by direct chill casting or semi-continuous casting, continuous casting (including, for example, by use of a twin belt caster, a twin roll caster, a block caster, or any other continuous caster), electromagnetic casting, hot top casting, extrusion, or any other casting method.

It will be appreciated that, while aspects of this disclosure relate to aluminum alloys, the concepts described herein may be applicable to other metals, such as magnesium alloys, that may be manufactured using the same or similar techniques and/or processed using the same or similar techniques described herein and useful for aluminum alloys.

FIG. 1 provides a plot showing example temperatures of a metal during various stages of a manufacturing process in accordance with some embodiments. As part of an initial casting stage 105 where molten metal is formed into an ingot, cast article, or other solid object or metal product, the molten metal may be cooled and/or solidified by a process involving quenching or cooling the metal by exposing the metal to water or an aqueous solution, such as in a direct chill casting process or in a continuous casting process that includes quenching immediately after casting.

Following the casting stage, the metal may be subjected to a homogenization process 110, where the metal is heated to a temperature less than the melting or solidus temperature of the metal. Optionally, the metal is heated to a temperature at which the base metal and any alloying elements form a solid solution.

Following the homogenization process, the metal may be exposed to one or more processes that may, for example, form desirable microcrystalline structures within the metal. Such processes may correspond to hot rolling 115 and/or cold rolling 120, for example, such as to form shates, plates, or sheets from a metal ingot or other cast article or metal product. In some embodiments, exposing a metal at an elevated temperature to a solution, such as water, an aqueous solution, or a gas-phase solution, in a quenching or cooling process may be used to reduce the temperature of the metal to a temperature desirable or useful for a subsequent process. For example, exposing the metal to water or an aqueous solution may be useful for cooling the metal between hot rolling process 115 and cold rolling process 120.

Following this, the metal may be subjected to a solution heat treatment process 125, where the temperature of the metal is increased to a temperature above a threshold temperature, such as a temperature at which the metal forms a solid solution, and held above the threshold temperature for a period of time. At the end of the solution heat treatment process 125, the metal may be subjected to a quenching process 130, where dissolved impurities are fixed into place by rapidly reducing the temperature of the metal by a quenching process. Such a quenching process 130 may involve exposing the metal to a solution, such as a quench solution including water, an aqueous solution, or a gas solution.

In embodiments, the processes overviewed in FIG. 1 may be performed discretely or as part of one or more continuous processing lines where metal may be transported as a coil, a film, or a web of material between processing stages. The metal may be transported between stages by rolling the metal, which may be under tension, over or between one or more rollers, or by transporting the metal on one or more conveyors, for example. In addition, other stages not explicitly identified may be included before, between, and/or after any stage identified in FIG. 1. Other example stages include, but are not limited to, an annealing stage, a washing stage, a chemical treatment stage, or a finishing stage. As an example, a finishing stage may correspond to a surface anodizing stage, a powder coating stage, a painting stage, a printing stage, and the like.

Figure 2:
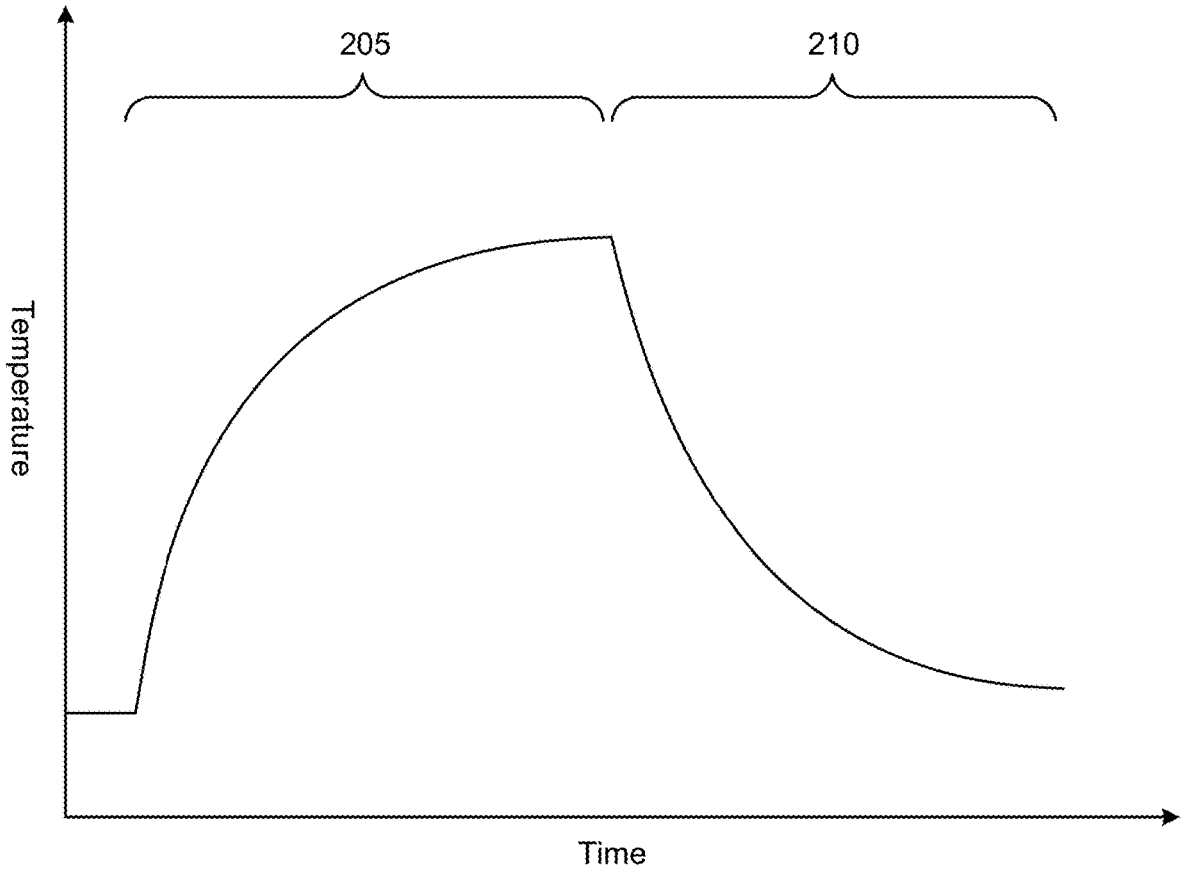
FIG. 2 is a plot showing metal temperature as a function of time during heating and quenching processes.

FIG. 2 provides a plot showing temperatures of a metal during solution heat treatment 205 and quenching processes 210 in accordance with some embodiments. The metal may be heated at any suitable rate using any suitable process to reach the threshold temperature and may be held at or above a particular temperature during the solution heat treatment for any suitable amount of time. The metal may be quenched using any suitable quenching technique to cool the temperature of the metal at one or more particular cooling rates. In embodiments, the metal is quenched by exposing the metal to a solution comprising water and one or more salts. It will be appreciated that, immediately prior to quenching, the metal may have any suitable temperature for the processing. As an example, the metal may be quenched at a starting temperature from about 500° C. to about 1500° C., depending on the metal composition.

Figure 3A:
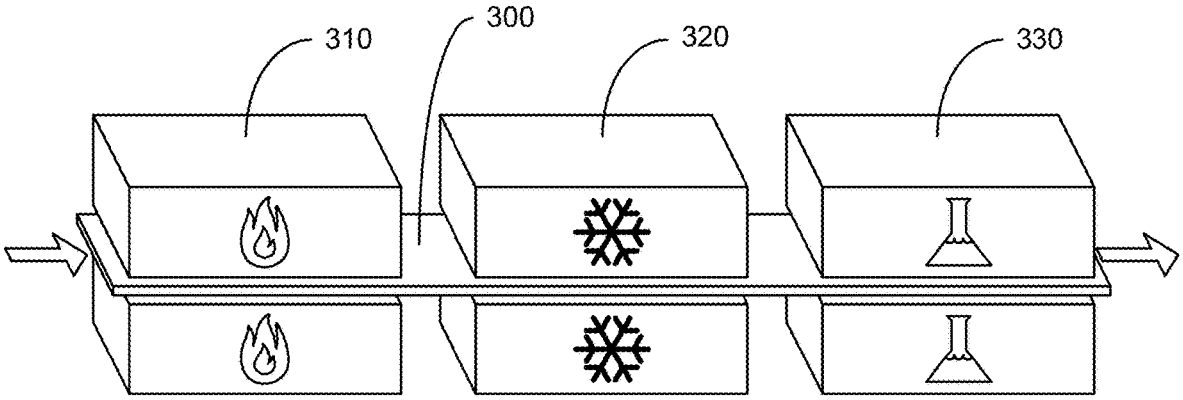
FIG. 3A and FIG. 3B each provide schematic illustrations of processes of treating metals in accordance with some embodiments.
Figure 3B:
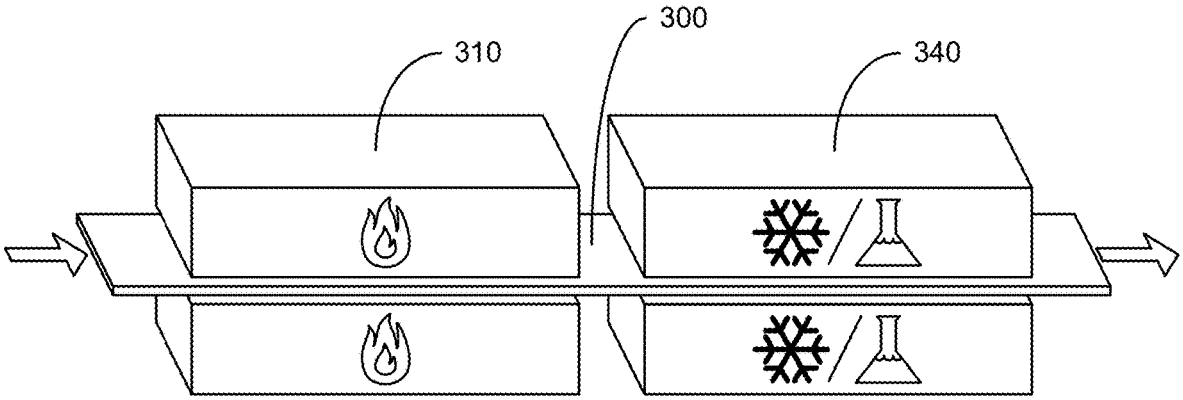

FIG. 3A and FIG. 3B provide schematic illustrations showing processes of treating a metal 300, in accordance with some embodiments. In FIG. 3A, metal 300 is subjected initially to a heating process 310, such as by transporting the metal 300 through a furnace or subjecting the metal 300 to another heating process, such as an electromagnetic induction heating process or a laser heating process, followed by a quenching process 320, followed by a chemical treatment process 330. One or more additional processes may be added between, before, or after any of the processes illustrated in FIG. 3A. The quenching process 320 may be used to reduce the temperature of the metal 300 following the heating process 310 to a temperature below 100° C., for example. The chemical treatment process 330 may correspond, for example, to one or more processes where the surface of the metal 300 may be modified. Upon quenching or by quenching, the metal 300 may be cooled to any suitable temperature, such as a temperature from about 25° C. to about 500° C. or any subrange thereof, for example, from 25° C. to 100° C., from 100° C. to 200° C., from 200° C. to 300° C., from 300° C. to 400° C., or from 400° C. to 500° C.

The processes illustrated in FIG. 3A may correspond, for example, to conventional techniques for treating metals and contrasts with those illustrated in FIG. 3B. In FIG. 3B, the metal 300 is subjected initially to a heating process 310, and then to a combined quenching and chemical treatment process 340. Again, one or more additional processes may be added between, before, or after the processes illustrated in FIG. 3B, such as a second chemical treatment process after combined quenching and chemical treatment process 340. In combined quenching and chemical treatment process 340, the temperature of the metal 300 may be reduced while a surface of the metal 300 may be simultaneously modified. For example, combined quenching and chemical treatment process 340 may include exposing the metal 300 to a solution to cool the metal at a cooling rate of from about 100° C./s to about 10000° C./s and to initiate a chemical reaction that modifies a surface of the metal, such as a chemical reaction that removes material from the surface of the metal or a chemical reaction that adds material to the metal. In some embodiments, cooling rates between 100° C./minute and 100° C./s may be employed, such as once a temperature of the metal reaches a target value. Optionally, a cooling rate during a quenching process changes as a function of time. Useful cooling rates achievable by the methods described herein include rates from about 100° C./s to about 10000° C./s or any subrange thereof, such as from about 100° C./s to about 2000° C./s, from about 200° C./s to about 2000° C./s, from about 300° C./s to about 2000° C./s, from about 400° C./s to about 2000° C./s, from about 500° C./s to about 2000° C./s, from about 600° C./s to about 2000° C./s, from about 700° C./s to about 2000° C./s, from about 800° C./s to about 2000° C./s, from about 900° C./s to about 2000° C./s, from about 1000° C./s to about 2000° C./s, from about 100° C./s to about 3000° C./s, from about 200° C./s to about 3000° C./s, from about 300° C./s to about 3000° C./s, from about 400° C./s to about 3000° C./s, from about 500° C./s to about 3000° C./s, from about 600° C./s to about 3000° C./s, from about 700° C./s to about 3000° C./s, from about 800° C./s to about 3000° C./s, from about 900° C./s to about 3000° C./s, from about 1000° C./s to about 3000° C./s, from about 1000° C./s to about 4000° C./s, from about 1000° C./s to about 5000° C./s, from about 1000° C./s to about 6000° C./s, from about 1000° C./s to about 7000° C./s, from about 1000° C./s to about 8000° C./s, from about 500° C./s to about 1500° C./s, from about 400° C./s to about 1400° C./s, from about 300° C./s to about 1300° C./s, from about 100° C./s to about 200° C./s, from about 200° C./s to about 300° C./s, from about 300° C./s to about 400° C./s, from about 400° C./s to about 500° C./s, from about 500° C./s to about 600° C./s, from about 600° C./s to about 700° C./s, from about 700° C./s to about 800° C./s, from about 800° C./s to about 900° C./s, from about 900° C./s to about 1000° C./s, from about 1000° C./s to about 1100° C./s, from about 1100° C./s to about 1200° C./s, from about 1200° C./s to about 1300° C./s, from about 1300° C./s to about 1400° C./s, from about 1400° C./s to about 1500° C./s, from about 1500° C./s to about 1600° C./s, from about 1600° C./s to about 1700° C./s, from about 1700° C./s to about 1800° C./s, from about 1800° C./s to about 1900° C./s, from about 1900° C./s to about 2000° C./s, from about 2000° C./s to about 2100° C./s, from about 2100° C./s to about 2200° C./s, from about 2200° C./s to about 2300° C./s, from about 2300° C./s to about 2400° C./s, from about 2400° C./s to about 2500° C./s, from about 2500° C./s to about 2600° C./s, from about 2600° C./s to about 2700° C./s, from about 2700° C./s to about 2800° C./s, from about 2800° C./s to about 2900° C./s, from about 2900° C./s to about 3000° C./s, from about 3000° C./s to about 3100° C./s, from about 3100° C./s to about 3200° C./s, from about 3200° C./s to about 3300° C./s, from about 3300° C./s to about 3400° C./s, from about 3400° C./s to about 3500° C./s, from about 3500° C./s to about 3600° C./s, from about 3600° C./s to about 3700° C./s, from about 3700° C./s to about 3800° C./s, from about 3800° C./s to about 3900° C./s, from about 3900° C./s to about 4000° C./s, from about 4000° C./s to about 4100° C./s, from about 4100° C./s to about 4200° C./s, from about 4200° C./s to about 4300° C./s, from about 4300° C./s to about 4400° C./s, from about 4400° C./s to about 4500° C./s, from about 4500° C./s to about 4600° C./s, from about 4600° C./s to about 4700° C./s, from about 4700° C./s to about 4800° C./s, from about 4800° C./s to about 4900° C./s, from about 4900° C./s to about 5000° C./s, from about 5000° C./s to about 5100° C./s, from about 5100° C./s to about 5200° C./s, from about 5200° C./s to about 5300° C./s, from about 5300° C./s to about 5400° C./s, from about 5400° C./s to about 5500° C./s, from about 5500° C./s to about 5600° C./s, from about 5600° C./s to about 5700° C./s, from about 5700° C./s to about 5800° C./s, from about 5800° C./s to about 5900° C./s, from about 5900° C./s to about 6000° C./s, from about 6000° C./s to about 6100° C./s, from about 6100° C./s to about 6200° C./s, from about 6200° C./s to about 6300° C./s, from about 6300° C./s to about 6400° C./s, from about 6400° C./s to about 6500° C./s, from about 6500° C./s to about 6600° C./s, from about 6600° C./s to about 6700° C./s, from about 6700° C./s to about 6800° C./s, from about 6800° C./s to about 6900° C./s, from about 6900° C./s to about 7000° C./s, from about 7000° C./s to about 7100° C./s, from about 7100° C./s to about 7200° C./s, from about 7200° C./s to about 7300° C./s, from about 7300° C./s to about 7400° C./s, from about 7400° C./s to about 7500° C./s, from about 7500° C./s to about 7600° C./s, from about 7600° C./s to about 7700° C./s, from about 7700° C./s to about 7800° C./s, from about 7800° C./s to about 7900° C./s, from about 7900° C./s to about 8000° C./s, from about 8000° C./s to about 8100° C./s, from about 8100° C./s to about 8200° C./s, from about 8200° C./s to about 8300° C./s, from about 8300° C./s to about 8400° C./s, from about 8400° C./s to about 8500° C./s, from about 8500° C./s to about 8600° C./s, from about 8600° C./s to about 8700° C./s, from about 8700° C./s to about 8800° C./s, from about 8800° C./s to about 8900° C./s, from about 8900° C./s to about 9000° C./s, from about 9000° C./s to about 9100° C./s, from about 9100° C./s to about 9200° C./s, from about 9200° C./s to about 9300° C./s, from about 9300° C./s to about 9400° C./s, from about 9400° C./s to about 9500° C./s, from about 9500° C./s to about 9600° C./s, from about 9600° C./s to about 9700° C./s, from about 9700° C./s to about 9800° C./s, from about 9800° C./s to about 9900° C./s, or from about 9900° C./s to about 10000° C./s. Optionally, a cooling rate during a quenching process is constant for at least a portion of the quenching process. For some embodiments, increasing a cooling rate during a quenching process may allow a manufacturing line speed to be increased, such as to a speed greater than that usable by quenching with a conventional quenching solution of pure water.

Without wishing to be bound by any theory, the inventors have found that use of an aqueous salt solution for quenching metal from a high temperature can achieve higher cooling rates than the use of pure water. Such high cooling rates may be possible using a solution comprising water and dissolved salts because the inclusion of the salts may reduce bubble formation and the Leidenfrost effect, which may occur when material having a temperature higher than the boiling temperature of the solution is immersed or contacted with the solution. Such high cooling rates are advantageous, for example, for solidifying a solid solution to lock in dissolved alloying metals in the base crystal or grain structure and minimize alloy clusters. Additionally, the inventors have found that high temperatures associated with quenching may be useful for initiating, driving, or increasing the rate of chemical reactions between reactive solutes in the solution with one another, with the surface or the metal, or by self-reaction of a reactive solute (e.g., thermal decomposition).

Figure 4:
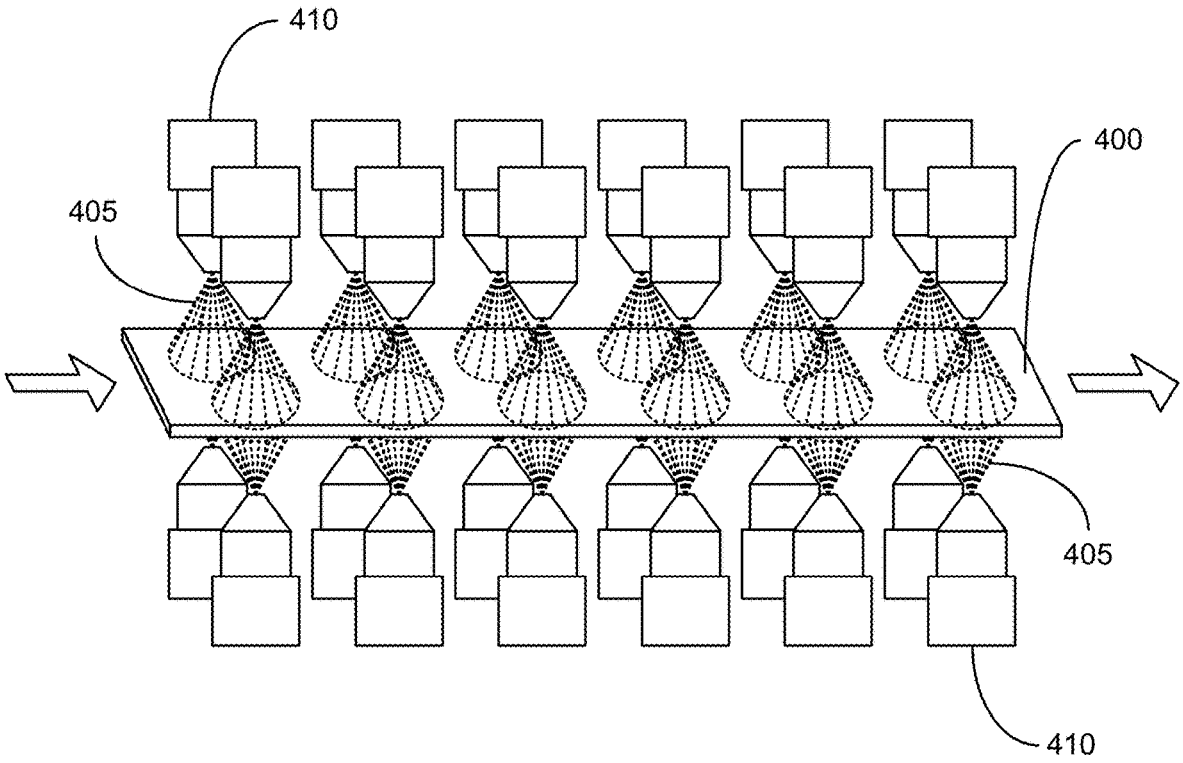
FIG. 4 provides a schematic illustration of a metal quenching operation in accordance with some embodiments.

FIG. 4 provides a schematic illustration of a quench technique useful with some embodiments. In FIG. 4, metal 400 is exposed to a solution 405 from a plurality of spray nozzles 410. Solution 405 may correspond to a gas-phase solution or a liquid solution. Other techniques may be useful for exposing metal 400 to solution 405, such as immersing the metal 400 in a bath or stream of solution 405, flowing a stream of solution 405 over metal 400, etc. Spray nozzles 410 may be advantageously used, however, as the amount of solution 405 provided by each nozzle 410 and the composition, concentration, and/or temperature of the solution 405 sprayed may be independently adjusted. Example temperatures for the solution include those from 0° C. to about 50° C., though higher temperature solutions will be useful for some embodiments. In general, useful solution temperatures correspond to any temperature or temperature subrange between the melting temperature of the solution and the boiling temperature of the solution. It will be appreciated that exposing metal 400 to solution 405 will result in the temperature of metal 400 being reduced when the temperature of metal 400 is above the temperature of solution 405; correspondingly, the temperature of solution 405 may be increased. Such a configuration is particularly useful to rapidly cool metal 400 when metal 400 enters a quenching stage at a high temperature, such as at a temperature where the base metal and alloying metals are present in a solid solution, or where metal 400 is present at a temperature above a boiling point of water or solution 405.

A variety of solutions are useful with various embodiments described herein. Optionally, the solution comprises a liquid solution. For example, in some embodiments, the solution comprises water and one or more salts, such as present in an aqueous solution. Use of a solution comprising water and one or more salts may be advantageous as, in embodiments, such a solution may provide for a faster cooling rate than use of water alone. Example solutions include those comprising one or more alkali metal salts (e.g., sodium sulfate), alkaline earth metal salts (e.g., magnesium sulfate), ammonium salts (e.g., ammonium sulfate), sulfate salts (e.g., potassium sulfate), nitrate salts (e.g., calcium nitrate), borate salts (e.g., potassium borate), phosphate salts (e.g., lithium phosphate), acetate salts (e.g., sodium acetate), carbonate salts (e.g., calcium carbonate or aluminum carbonate), calcium based salts, or aluminum based salts. In some embodiments, these and other salts may correspond to inert or non-reactive salts that do not or only minimally interact with or undergo chemical reaction with one another or the surface of a metal or metal product. The salts in the solution may be present at any suitable concentration, such as a salt concentration of from about 5 wt. % salt to about 30 wt. % salt or any subrange thereof, such as from about 5 wt. % to about 25 wt. %, from about 5 wt. % to about 20 wt. %, from about 5 wt. % to about 15 wt. %, from about 5 wt. % to about 10 wt. %, from about 10 wt. % to about 30 wt. %, from about 10 wt. % to about 25 wt. %, from about 10 wt. % to about 20 wt. %, from about 10 wt. % to about 15 wt. %, from about 15 wt. % to about 30 wt. %, from about 15 wt. % to about 25 wt. %, from about 15 wt. % to about 20 wt. %, from about 5 wt. % to about 6 wt. %, from about 6 wt. % to about 7 wt. %, from about 7 wt. % to about 8 wt. %, from about 8 wt. % to about 9 wt. %, from about 9 wt. % to about 10 wt. %, from about 10 wt. % to about 11 wt. %, from about 11 wt. % to about 12 wt. %, from about 12 wt. % to about 13 wt. %, from about 13 wt. % to about 14 wt. %, from about 14 wt. % to about 15 wt. %, from about 15 wt. % to about 16 wt. %, from about 16 wt. % to about 17 wt. %, from about 17 wt. % to about 18 wt. %, from about 18 wt. % to about 19 wt. %, from about 19 wt. % to about 20 wt. %, from about 20 wt. % to about 21 wt. %, from about 21 wt. % to about 22 wt. %, from about 22 wt. % to about 23 wt. %, from about 23 wt. % to about 24 wt. %, from about 24 wt. % to about 25 wt. %, from about 25 wt. % to about 26 wt. %, from about 26 wt. % to about 27 wt. %, from about 27 wt. % to about 28 wt. %, from about 28 wt. % to about 29 wt. %, or from about 29 wt. % to about 30 wt. %.

In some embodiments, the solution comprises a saturated or supersaturated salt solution. The term "saturated salt solution" corresponds, in embodiments, to an aqueous solution that contains a maximum concentration of a particular dissolved salt and in which no additional amount of the particular salt can be dissolved. The maximum amount of dissolved salt in a saturated salt solution may be dependent on the temperature of the solution and the chemical identity of the salt. In embodiments, a saturated salt solution corresponds to a saturated room temperature salt solution. Saturated solutions may, for example, include a precipitated amount of salt. A "supersaturated salt solution" corresponds, in embodiments, to an aqueous solution that contains a salt concentration above an otherwise normal saturation concentration for the particular solute and temperature of the solution. Supersaturated salt solutions may be obtained, for example, by creating a saturated salt solution at a first temperature and lowering the temperature of the solution at a rate faster than the precipitation or crystallization rate. It will be appreciated that the solubility of different salts in water may be different and that different salts may exhibit different maximum salt concentrations in a solution.

Optionally, the solution comprises a gas-phase solution, such as including one or more reactive gases as a reactive solute for participating in a chemical reaction that modifies a surface of a metal and one or more non-reactive or inert gases as a solvent. Any suitable inert gas may be employed as a solvent in a gas-phase solution, such as argon, helium, nitrogen, etc. A variety of different reactive gases may be employed, such as hydrogen, oxygen, ammonia, sulfur dioxide, nitric oxide, nitrogen dioxide, silane, or gas-phase acidic species, such as hydrogen sulfide, hydrogen cyanide, hydrochloric acid, acetic acid, formic acid, etc. Reactive gases may be present in the solution at from about 0.1 wt. % to about 10 wt. %. Even at low concentrations, the reactive gases may participate in a surface-modifying reaction since the temperature of the surface of the metal may be elevated or at a temperature suitable for heat treatment of the metal, such as greater than 500° C. or approaching the melting temperature or solidus temperature of the metal.

In some embodiments, it may be desirable to minimize or eliminate certain ions from the solution. For example, in some embodiments, the presence of halide ions may be undesirable for use in a solution. Optionally, the solution lacks or does not include (i.e., excludes) halide ions. However, it may be practically impossible to remove or exclude all halide ions from a solution containing one or more salts. Accordingly, some embodiments make use of solutions including a concentration of halide ions between 0 wt. % to about 0.001 wt. %.

In some embodiments, salts or other reactive solutes that do react with the surface of a metal or one another may be present in the solution. For example, exposing the metal to such a solution may initiate a chemical reaction that modifies the surface of the metal. Example reactions may include those that remove material from the surface or deposit material onto the surface. Example reactions may include cleaning or etching the surface of the metal or forming a coating on the surface of the metal.

As examples, the solution may optionally comprise an aqueous alkaline solution or an aqueous acidic solution. Use of alkaline or acidic solutions may be advantageous, for example, as these solutions may serve as cleaners or etchants of a metal surface. Alkaline or acidic solutions may advantageously degrade materials adhered to or that form part of a metal surface, such as an oxide layer, particulate contaminants, etc. Removal of an oxide layer may be useful for allowing reactions between reactive solutes and the underlying metal atoms of a metal. In addition, alkaline or acidic solutions may also provide catalysts for reactions involving other salts or components of a solution, for example. Example alkaline solutions include those including hydroxides (e.g., sodium hydroxide, potassium hydroxide, etc.), ammonia (e.g., aqueous ammonia), calcium-based salts, or aluminum-based salts. Example acidic solutions include those comprising sulfuric acid, nitric acid, phosphoric acid, boric acid, or an organic acid, such as a sulfonic acid or a carboxylic acid.

As another example, the solution may optionally comprise one or more thermally decomposable species, such as thermally decomposable salts, as a reactive solute. Thermally decomposable species may be used to provide metals or other materials as a surface treatment of the metal. As an example, one or more thermally decomposable metal salts may be included in the solution, such as one or more chromium salts (e.g., chromium (III) salts), copper salts (e.g., copper (II) salts), silver salts (e.g., silver (I) salts), titanium salts (e.g., titanium (III) salts, titanium (IV) salts), zirconium salts (e.g., zirconium (IV) salts), manganese salts (e.g., manganese (II) salts), or cerium salts (e.g., cerium (III) salts, cerium (IV) salts). In addition to thermally decomposable metal salts, thermally decomposable metal compounds or ionic species including the previously mentioned metals may be employed, such as permanganate salts, as reactive solutes in a solution. It will be appreciated that some decomposable metal salts useful in the methods described herein may be less toxic than other metal salts or ions that may be used in conventional surface treatments. For example, chromium (III) may be less toxic than chromium (VI). Other or related thermally decomposable salts include, for example, nitrate salts, nitrite salts, carbonate salts, hydrogen carbonate salts, phosphate salts, hydrogen phosphate salts, dihydrogen phosphate salts, or permanganate salts. In embodiments, including a thermally decomposable metal salt in a solution may allow for formation of a metal or metal oxide layer of the metal from the decomposable metal salt on a surface of a metal, such as a sheet, shate, or plate, since the temperature of the solution or components thereof may be increased during the quenching process where the metal sheet, shate, or plate, at an elevated temperature, is exposed to the solution.

As another example, the solution may comprise one or more polymers (e.g., thermoset polymers) or polymer precursors. Useful polymers or polymer precursors include, but are not limited to acrylic acids, polyacrylic acids, vinyl phosphonic acids, and polyvinyl phosphonic acids. Inclusion of polymers or polymer precursors in the solution may allow for deposition of a polymer layer onto the surface of the metal during the quench process. In some embodiments where the solution includes a polymer precursor, exposing the polymer precursors to an elevated temperature or amount of heat, such as provided by the metal exiting a furnace or heating stage, may initiate a polymerization or crosslinking reaction of the polymer precursors to form a polymer. Example polymer or polymer precursor concentrations in the solution include from about 0.1 wt. % to about 10 wt. % polymer or polymer precursor.

Other additives may be included in the solution. For example, in some embodiments, the solution may comprise insoluble particles. Insoluble particles may take the form of small objects of material that may be suspended in or otherwise transported by the solution as it flows. In embodiments, particles may be characterized by sizes such as diameters, from 5 nm to 500 micrometers, for example. When particles have very small diameters, such as less than 1 micrometer, the particles may form a colloid or suspension in a solution. Optionally, the solution comprises suspended reactive media alternative to or in addition to a reactive solute. Such a solution may comprise a colloidal suspension of the suspended reactive media in a solvent. Larger particles may be transported by a solution through bulk transport processes, where forces imparted by flowing fluid overcome gravitational or inertial processes. Exemplary insoluble particles may comprise inorganic materials, such as metals, metal oxide materials, or plastic or polymeric materials, that may be naturally occurring or synthetic or processed to form objects of a particular size, such as diameter. Example insoluble particles may correspond to glass, silica, plastic, metal, or rubber. In some embodiments, crystals or amounts of salts present in a saturated solution may correspond to insoluble particles. In some embodiments, insoluble particles have a hardness greater than, less than, or about equal to a hardness of a metal being treated by exposure of the metal to the solution. In some examples, exposure of a metal to a solution may impart a force on a surface layer of the metal, resulting in a condensed, densified, or otherwise compressed layer at the surface of the metal. In some examples, exposure of a metal to a solution may impart a force on a surface layer of the metal, resulting in etching, eroding, ablation, or otherwise removing material from the surface of the metal. Such etching, eroding, ablation, or surface removal processes may be advantageous, for some embodiments, by exposing fresh (i.e., non-oxidized or unreacted) metal and allowing for a faster etching or surface reaction with the fresh metal to occur.

Various process parameters may be selected and established in order to control a reaction rate and/or a cooling rate. For example, for certain surface modification reactions, it may be desirable to allow the reaction to proceed at a low rate or at a high rate. Similarly, it may also be desirable to control a rate at which quenching of a heated metal occurs, such as to control or establish a particular grain structure, precipitate concentration, precipitate distribution, alloying element concentration, alloying element distribution, or the like. By selecting and establishing one or more process parameters, the cooling and/or reaction rates may be controlled to achieve target properties and/or surface modification of the metal. Example process parameters include, but are not limited to a solute or salt concentration in the solution, a chemical identity of a solute or salt in the solution, a flow rate for the solution, a pressure of the solution, a solution spray angle, spray direction, or geometry used during exposing the heated metal to the solution, a solution temperature (e.g., temperature of the solution prior to the exposure), a time duration of the exposure of the metal to the solution, or any combination of these.

Process parameters may also be variable and/or controlled as a function of time. For example, a solute concentration may vary over time, such as to control an etch rate and/or deposition rate. As another example, a chemical identity of a reactive solute in a solution may be changed over time. In one embodiment, for example, a reactive solute that is an etchant may be present in the solution initially. As an etching reaction proceeds during exposure of a heated metal to the solution, the concentration of the etchant may change (e.g., be decreased) to modify the etching rate. Optionally, the solution may be modified to include a second reactive solute, such as a decomposable solute that decomposes to form a deposited layer over the metal. Further, depending on the conditions, the concentration of the decomposable solute may be changed over time. For example, the decomposable solute may have a concentration that begins at zero, is increased to a low concentration to begin an initial low-rate deposition during a first time period, and then increases to higher concentration for higher-rate deposition during a second time period. During such a process, quenching or cooling of the metal from the initial temperature may occur. Further, a non-reactive solute (e.g., salt) concentration in the solution, solution flow rate, solution pressure, or other process parameters may also be controlled as a function of time to establish a particular quench profile or temperature profile within the metal.

Figure 5:
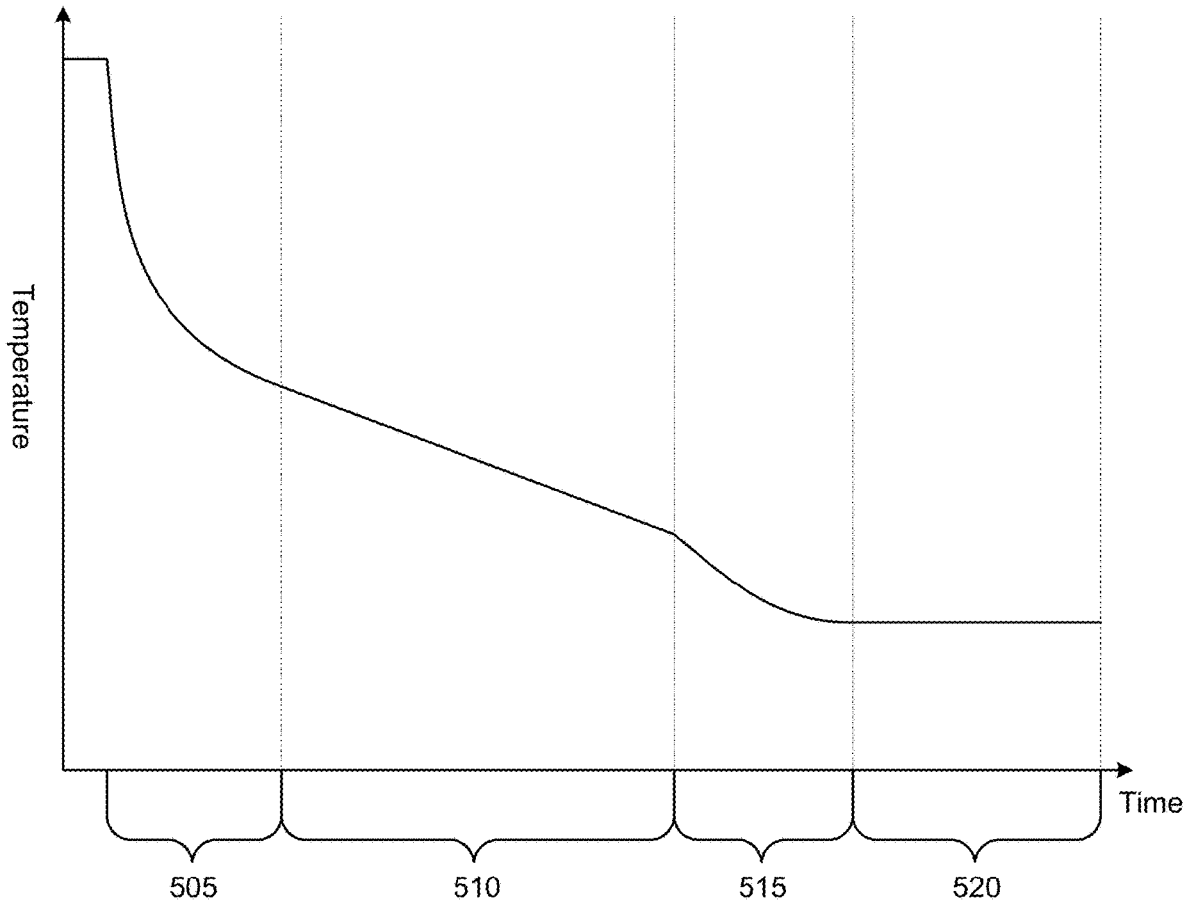
FIG. 5 is a plot showing metal temperature as a function of time during a multi-stage quench and surface treatment process.

Various quenching processes may be useful with embodiments described herein. For example, in some embodiments, exposing the metal to a solution corresponds to a single quench process, such as having a temperature profile similar to that illustrated in FIG. 2. In other embodiments, the quench process may be more complex. For example, FIG. 5 provides a plot showing temperatures of a metal during an exemplary quenching process including multiple quenching stages. A first quench stage 505 may be used, which may correspond to rapidly cooling the temperature of a metal, such as following a casting step, an annealing step, or a heat treatment process. In the first quench stage 505, the cooling rate decreases as a function of time, starting from a maximum cooling rate and ending at a minimum cooling rate. A second continuous quench stage 510 may be used, such as where the cooling rate remains constant. A third quench stage 515 may be used, where the cooling rate again is not constant and reduces as a function of time, starting from a maximum cooling rate and ending at a minimum cooling rate. A fourth stage 520 follows, where the cooling rate may be constant or zero, for example.

In this way, different temperature and cooling regimes may be used to meet cooling requirements, reaction requirements, or materials requirements, for example. As an example, it may be desirable to initially quench the temperature of the metal at as fast a cooling rate as possible, such as to solidify a solid solution and lock in the dissolved alloying metals in the base crystal/grain structure and minimize alloy clusters or other precipitates. A reduced cooling rate or constant cooling rate or constant temperature regime may be useful for allowing a desired chemical reaction to take place, such as a reaction that operates only within or most efficiently within a particular temperature range. Once a particular reaction requiring a particular temperature or temperature range is complete, it may be desirable to quickly change the temperature of the metal to another temperature, such as by way of a subsequent quench.

Figure 6A:
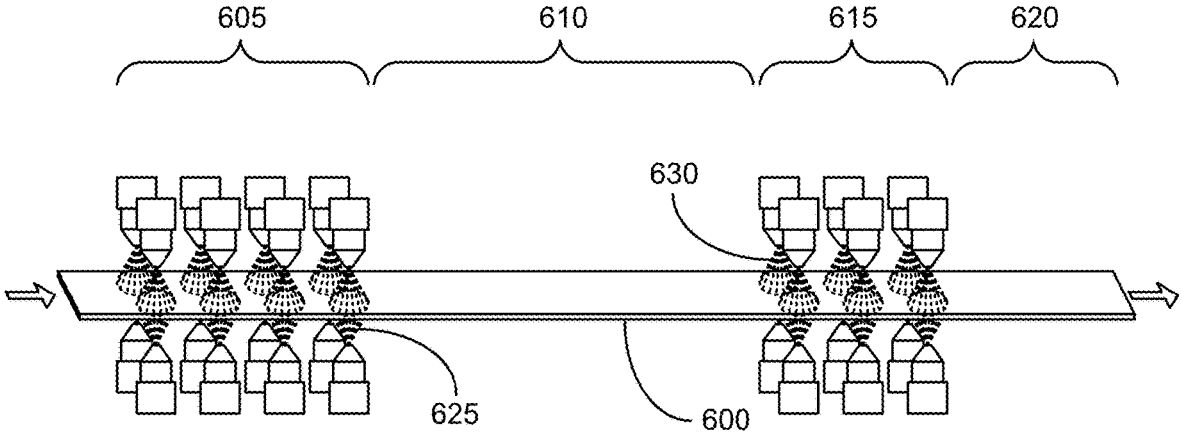
FIG. 6A and FIG. 6B each provide schematic illustrations of a metal quenching operation in accordance with some embodiments.
Figure 6B:
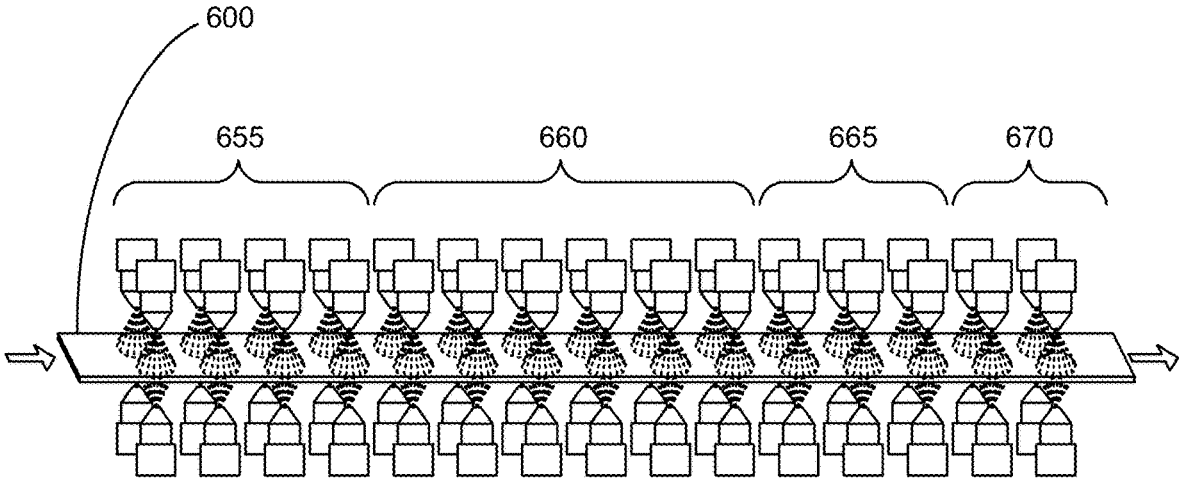

FIGS. 6A and 6B provide schematic illustrations of a metal quenching operation including multiple quench stages. The configurations depicted in each of FIGS. 6A and 6B may be useful, for example, for providing the temperature profile depicted in FIG. 5, but using different quenching techniques and arrangements.

In FIG. 6A, a first quenching stage 605 applies a first quenching solution 625 to quickly cool metal 600 from its highest temperature, which may correspond to the temperature the metal 600 is raised to in a furnace or other heating stage (e.g., electromagnetic induction or laser heating stage) prior to the quenching stage, such as a solution heat treatment temperature. As noted above, it may be desirable to control the cooling rate following first quenching stage 605 to be constant, such as to allow a chemical reaction to occur, or for other reasons.

In second quenching stage 610 depicted in FIG. 6A, no solution is applied to metal 600 and metal 600 is allowed to cool, for example, through conductive heat transport with other sections of metal 600, where heat is being actively removed, and through convective heat transport with the air. In second quenching stage 610, material retained on the surface of metal 600 may, for example, react with the surface of metal 600 at the elevated temperatures encountered in quenching stage 610.

In third quenching stage 615, a second solution 630 is applied to metal 600. Second solution 630 may be the same as or different from the first solution 625 applied in first quenching stage 605. In addition, a temperature or flow rate of the second solution 630 may be the same as or different from those used for first solution 625 in first quenching stage 605.

Following third quenching stage 615, a fourth stage 620 may be used, where again no solution is applied. In FIG. 6A, fourth stage 620 shows an approximate constant temperature and this stage may be useful for embodiments where additional cooling is not needed or is needed only at a low rate.

In contrast with FIG. 6A, FIG. 6B depicts a continuous or approximately continuous quenching along multiple regions, but includes different quenching stages, as described below. The solution composition, solution temperature, and solution flow rate at each spray nozzle may be independent from those used at other spray nozzles. For example, the composition, temperature, and flow rates of quenching solutions used at each spray nozzle may be continuously and independently varied from spray nozzle to spray nozzle. Optionally, the solution applied at any one or more nozzles may comprise water having no or only trace amounts of dissolved salts, which may be useful for providing a surface wash or for preventing different composition solutions in adjacent nozzles from mixing.

In the embodiment depicted in FIG. 6B, first quenching stage 655 may correspond generally to first quenching stage 605 in FIG. 6A, where a first quenching solution is applied, such as to quickly cool metal 600 from its highest temperature. Each of the spray nozzles in first quenching stage 655 may apply the same composition and temperature solution at the same flow rate, for example.

Following first quenching stage 655, second quenching stage 660 applies a second quenching solution to metal 600. To achieve a different cooling rate than achieved in first quenching stage 655, a second quenching solution is applied, which may have a different composition or different temperature, for example, from the first quenching solution applied in first quenching stage 655. Alternatively or additionally, the second quenching solution may have the same composition as the first quenching solution, but may be applied at a lower flow rate. These configurations may advantageously allow a target cooling rate to be achieved, as desired.

Third quenching stage 665 may apply a third quenching solution, which again may be the same or different from the first quenching solution used in first quenching stage 655 or the second quenching solution used in second quenching stage 660. Alternatively or additionally, a temperature or flow rate of the third quenching solution may be different from that used in other quenching stages.

Fourth quenching stage 670 may apply a fourth quenching solution and the composition, temperature, and flow rate of the fourth quenching solution may be again optimized to achieve a target cooling rate. Optionally, any one or more nozzles may have a zero flow rate, effectively allowing selective application or not of a quenching solution.

As a specific example for FIG. 6B useful for some embodiments, the first quenching solution may correspond to an alkaline solution, such as an aqueous solution of sodium hydroxide and/or potassium hydroxide. Such a solution may be useful for cleaning or etching a surface of the metal 600 in addition to reducing a temperature of metal 600 by quenching. The second quenching solution may correspond, for example, to an alkaline solution being applied, but at an increasingly diluted concentration, to achieve a constant cooling rate. The third quenching solution may correspond, for example, to a salt solution of a thermally decomposable salt to allow formation of a coating on the surface of metal 600 during quenching by thermally decomposing a salt present in the third quenching solution. The fourth quenching solution may correspond to a pure water wash, for example.

The following examples will serve to further illustrate the present invention without, at the same time, however, constituting any limitation thereof. On the contrary, it is to be clearly understood that resort may be had to various embodiments, modifications and equivalents thereof which, after reading the description herein, may suggest themselves to those skilled in the art without departing from the spirit of the invention. During the studies described in the following examples, conventional procedures were followed, unless otherwise stated. Some of the procedures are described below for illustrative purposes.

Example 1: Reactive Quenching for Cleaning Metal Surfaces

A 7xxx series aluminum alloy is cast and prepared for solution heat treatment. The aluminum alloy is subjected to a solution heat treatment by passing the aluminum alloy through a furnace until the aluminum alloy reaches a temperature of about 450° C. The temperature is held between 450° C. and the solidus temperature for between 0.5 and 120 minutes, inclusive. Example solidus temperatures for various 7xxx series aluminum alloys include from about 470 to about 650° C. Following the solution heat treatment process, the aluminum alloy is quenched as follows.

The heat-treated aluminum alloy at approximately 450° C. is immersed in an aqueous salt solution containing about 5-35% by weight of potassium hydroxide at about 25° C. while its temperature is monitored. Cooling rates of between 50° C./s and 400° C./s or greater may be observed. The aluminum alloy is allowed to cool to a final temperature of about 50° C. or less. This process removes a layer of material from the surface of the aluminum alloy.

Figure 7:
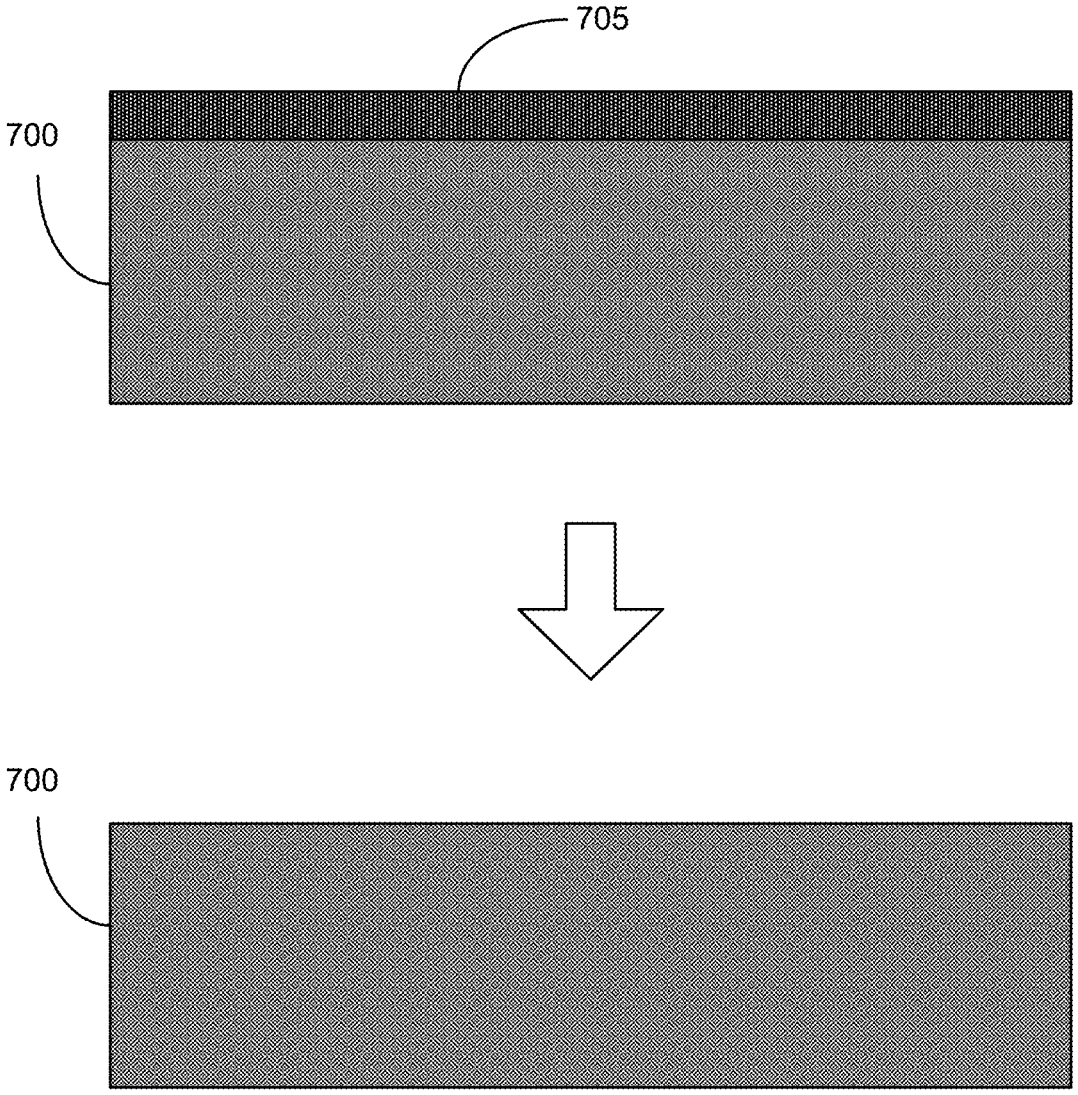
FIG. 7 provides a schematic overview of a process of removing material from a metal surface.

FIG. 7 provides schematic cross sectional views of an aluminum alloy 700 before (top) and after (bottom) quenching. In FIG. 7, aluminum alloy 700 has a surface layer 705 before quenching. During quenching, surface layer 705 is removed through reaction with the potassium hydroxide solution. Although surface layer 705 is illustrated schematically in FIG. 7 as a distinct layer, it will be appreciated that surface layer 705 may correspond to a continuous region of aluminum alloy 700 that is removed during quenching. As an example, surface layer 705 may be up to 5 μm thick.

Example 2: Reactive Quenching for Coating Metal Surfaces

A 7xxx series aluminum alloy is cast and prepared for solution heat treatment. The aluminum alloy is subjected to a solution heat treatment by passing the aluminum alloy through a furnace until the aluminum alloy reaches a temperature of about 450° C. The temperature is held between 450° C. and the solidus temperature for between 0.5 and 120 minutes, inclusive. Following the solution heat treatment process, the aluminum alloy is quenched as follows.

The heat treated aluminum alloy at approximately 450° C. is immersed in an aqueous salt solution containing about 5-35% by weight of chromium (III) nitrate salt at about 25° C. while its temperature is monitored. Cooling rates of between 50° C./s and 400° C./s or greater may be observed. The aluminum alloy is allowed to cool to a final temperature of about 50° C. or less. This process deposits a chromium containing layer onto a surface of the aluminum alloy.

Figure 8:
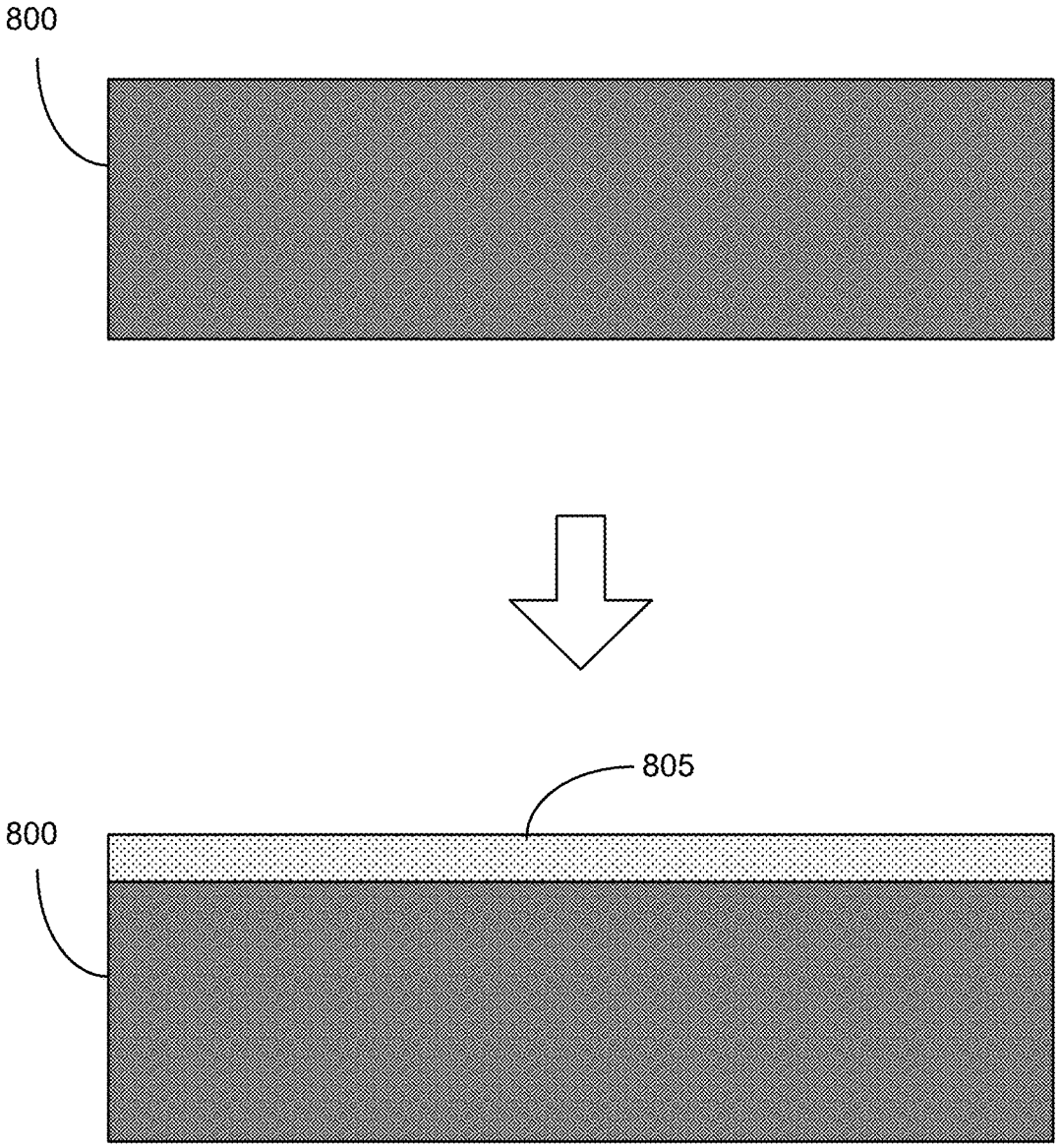
FIG. 8 provides a schematic overview of a process of adding material to a metal surface.

FIG. 8 provides cross sectional views of the aluminum alloy 800 before (top) and after (bottom) quenching. In FIG. 8, aluminum alloy 800 has a surface layer 805 formed during quenching, corresponding to a chromium (III) oxide layer formed by thermal decomposition of the chromium (III) nitrate in solution. An example thermal decomposition reaction for chromium (III) nitrate follows:

$$4\,Cr(NO_3)_3 \xrightarrow{\Delta} 2\,Cr_2O_3 + 12\,NO_2 + 3\,O_2.$$

Example 3: Evaluation of Reactive Quenching

Samples of a variation of a 6111 series aluminum alloy were prepared for reactive quenching. Initially, the aluminum alloy was cast and rolled into a sheet. After cold rolling, the sheet had a gauge of about 2 mm. The samples were degreased by treatment with hexane in preparation for reactive quenching. One sample was retained in the asprepared degreased mill finish condition and was not subjected to heating and quenching. The other samples were subjected to a reactive quenching process, where samples of the aluminum alloy product were initially heated from ambient temperature to about 300° C. over a period of about 7 minutes by placing the samples in a furnace held at about 300° C.

While at a temperature of about 300° C., the samples were subjected to quenching by exposure to different solutions. As a control, one sample was quenched by exposing to deionized (DI) water at a temperature of about 65° C. for about 5 seconds. Other samples were quenched by exposure to various solutions including reactive solutes. For example, two samples were quenched using by exposure to a solution including about 1 percent by volume of a titanium/zirconium salt in deionized water for about 5 seconds; one of the solutions was at about 65° C. and the other was at about ambient temperature. Two samples were quenched using weakly acidic conditions by about a 5 second exposure to a solution of about 3 percent by volume of sulfuric acid ($H_2SO_4$) in deionized water or to a solution of about 3 percent by volume of phosphoric acid ($H_3PO_4$) in deionized water, with both the weakly acidic solutions at about 65° C. Two samples were quenched using weakly basic conditions by about a 5 second exposure to a solution of about 3 percent by volume of potassium hydroxide (KOH) with the solution at about 65° C.; after quenching one of the samples exposed to the potassium hydroxide solution was rinsed with ambient temperature deionized water and desmutted by exposure to a solution of about 20 g/L nitric acid ($HNO_3$) in deionized water for about 5 seconds. Initial quench rates between about 200° C./s and about 400° C./s were observed for all quenched samples. All quenched samples were subsequently rinsed with room temperature deionized water for further evaluations.

Figure 9A:
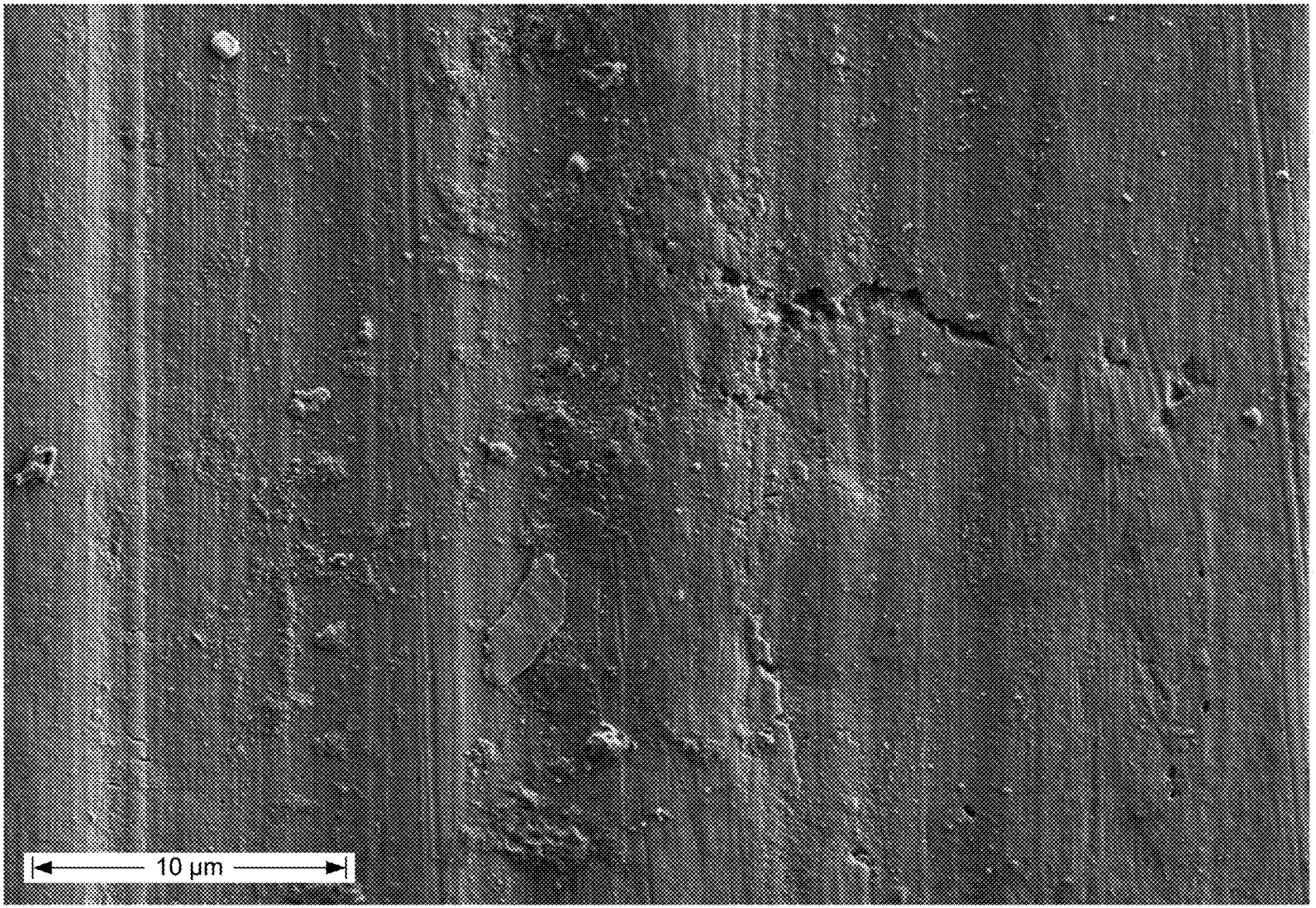
FIG. 9A provides an electron micrograph image of an aluminum alloy product quenched using deionized water.
Figure 9B:
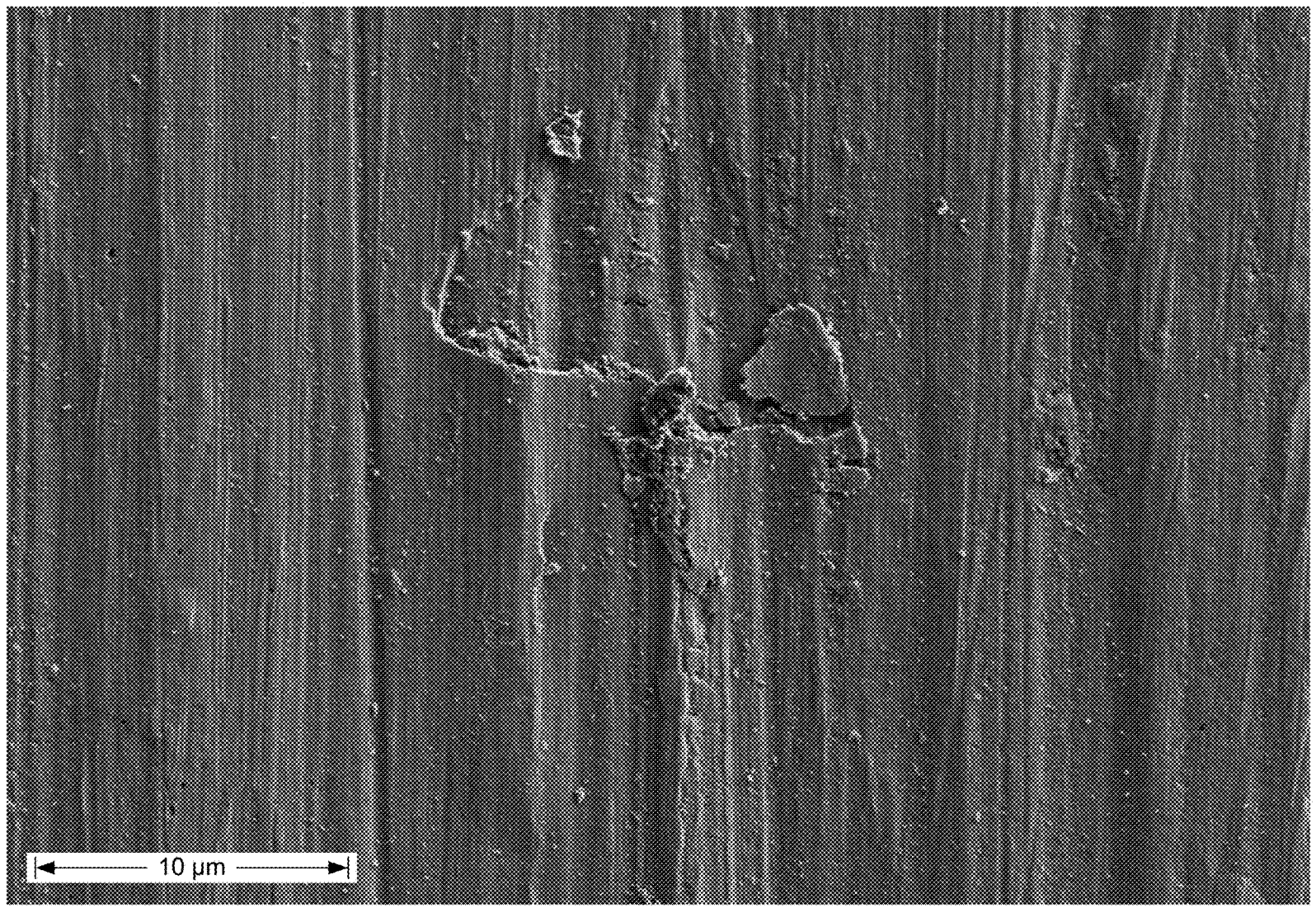
FIG. 9B and FIG. 9C provide electron micrograph images of aluminum alloy products quenched using Ti/Zr containing solutions.
Figure 9C:
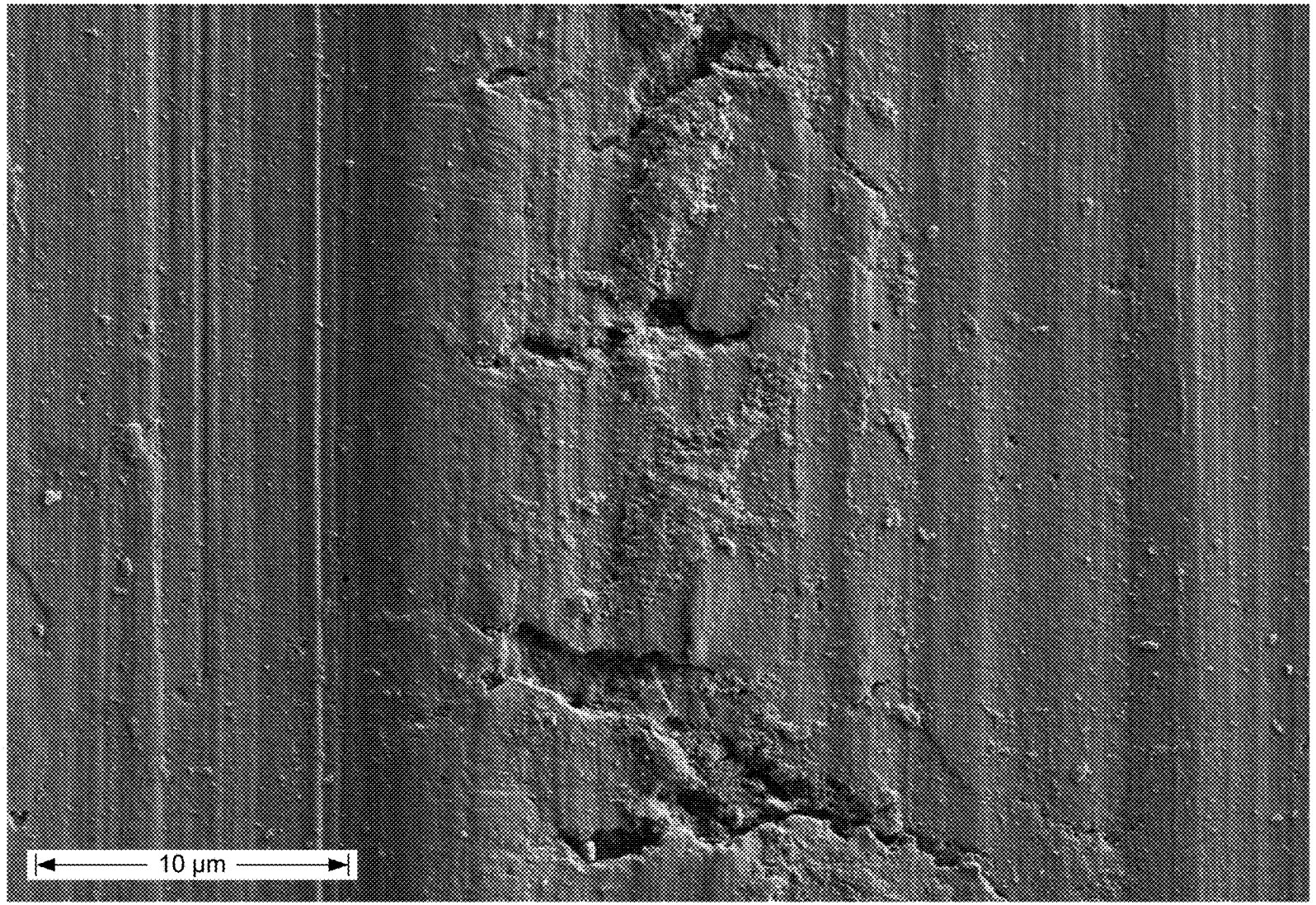
Figure 9D:
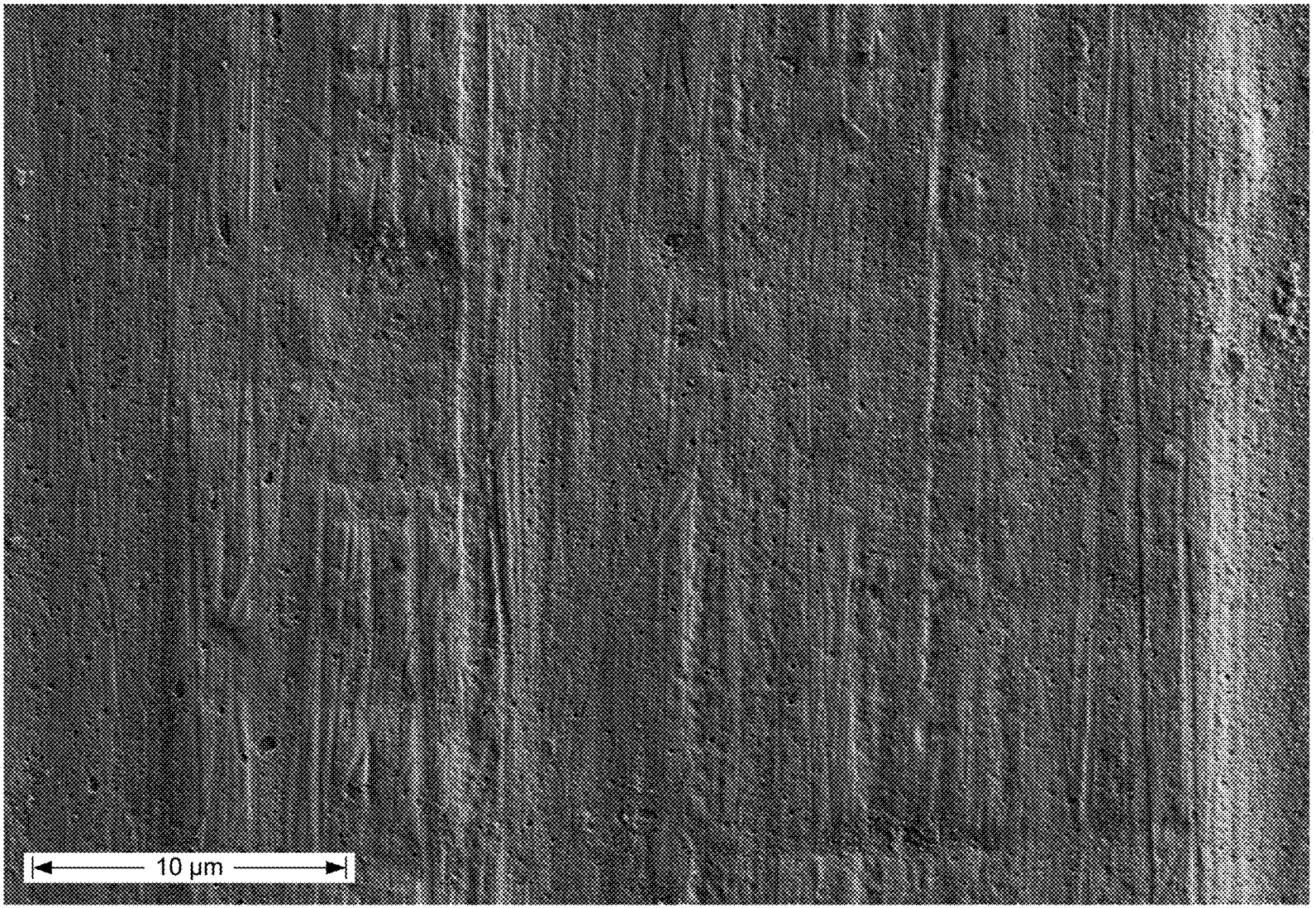
FIG. 9D provides an electron micrograph image of an aluminum alloy product quenched using a sulfuric acid solution.
Figure 9E:
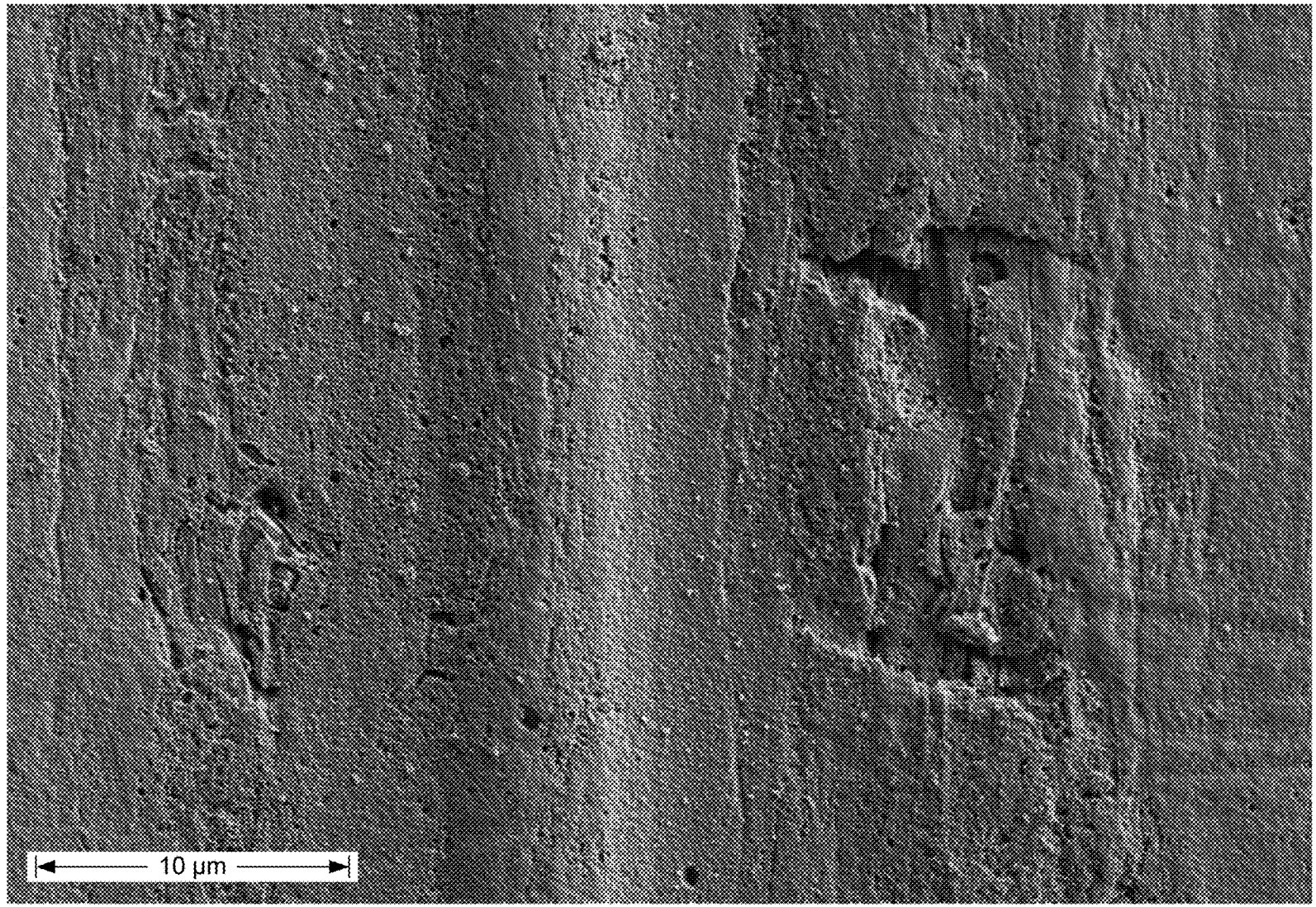
FIG. 9E provides an electron micrograph image of an aluminum alloy product quenched using a phosphoric acid solution.
Figure 9F:
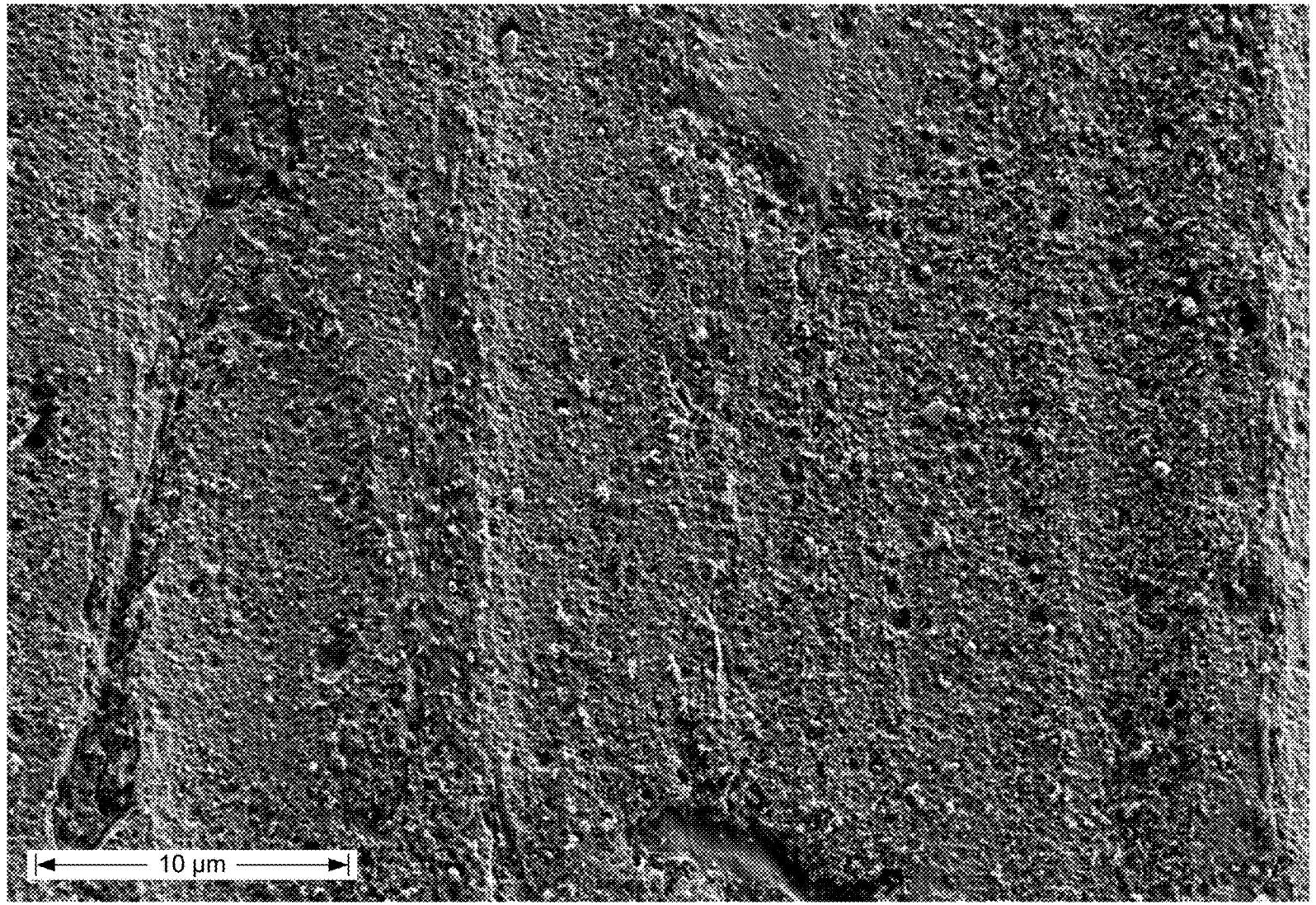
FIG. 9F and FIG. 9G provide electron micrograph images of aluminum alloy products quenched using potassium hydroxide solutions.
Figure 9G:
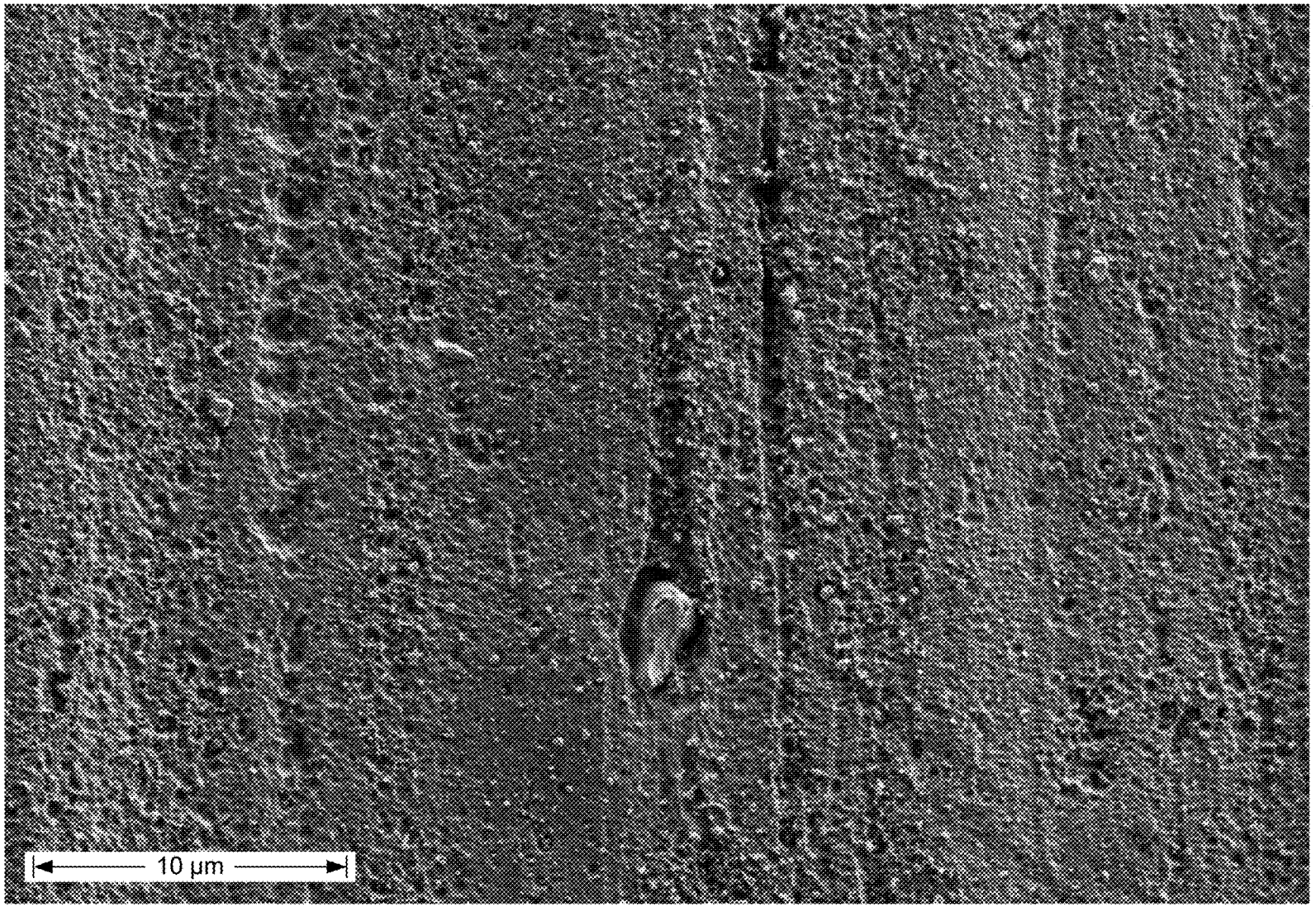

Electron micrograph images of the samples were obtained to provide qualitative information about the samples. FIG. 9A provides an electron micrograph image of the sample quenched using 65° C. deionized water, showing a relatively clean surface with rolling lines visible and was comparable to the mill finish sample (not depicted). FIG. 9B provides an electron micrograph image of the sample quenched using the 65° C. Ti/Zr solution and FIG. 9C provides an electron micrograph image of the sample quenched using the ambient temperature Ti/Zr solution, again showing a relatively clean surface with rolling lines visible. FIG. 9D provides an electron micrograph image of the sample quenched using the 65° C. sulfuric acid solution, with some degradation of rolling lines noticeable as compared to the water quenched sample, reflecting etching of the surface. FIG. 9E provides an electron micrograph image of the sample quenched using the 65° C. phosphoric acid solution, with stronger etching of the surface noticeable. FIG. 9F provides an electron micrograph image of the sample quenched using the 65° C. potassium hydroxide solution and FIG. 9G provides an electron micrograph image of the sample quenched using the 65° C. potassium hydroxide solution followed rinsing and desmutting. The potassium hydroxide quenched samples appear to have the mostly strongly etched surfaces of all those tested.

To further determine the effects of the reactive quenching, the samples were also subjected to surface x-ray photoelectron spectroscopy to investigate the compositional changes that took place at the surface of the samples. Overall results are provided in Table 1. To evaluate the effects of etching by reactive quenching, integrated XPS signals to 140 nm depths for carbon (e.g., corresponding to residual rolling oils or hexane present on or within a surface microstructure of the samples' surfaces) and magnesium were obtained. The integrated carbon XPS signal for the control sample (DI water quench) had a value of 336, while the integrated magnesium XPS signal was 42 for the control sample. The phosphoric and sulfuric acid quenched samples had integrated carbon XPS signals of 25 and 61, respectively, and integrated magnesium XPS signals of 9 and 23, respectively. The potassium hydroxide quenched sample had an integrated carbon XPS signal of 44 and an integrated magnesium XPS signal of 46, while the sample subjected to potassium hydroxide quench followed by desmutting had an integrated carbon XPS signal of 25 and an integrated magnesium XPS signal of 23, indicating that the potassium hydroxide quench was able to remove carbon from the surface, but not very effective at removing magnesium, even after a desmut. These results, combined with the micrograph images, show that both acidic and basic reactive quench solutions is useful for etching the surface of an aluminum alloy product.

TABLE 1

Integrated Atomic XPS Signals to 140 nm

| | C | Mg | Zr |
|---|---|---|---|
| DI Water at 65° C. | 336 | 42 | 7 |
| Ti/Zr solution at 65° C. | 135 | 40 | 30 |
| Ti/Zr solution at ambient | 293 | 43 | 10 |
| KOH solution followed by desmut | 26 | 23 | 1 |
| KOH solution | 44 | 46 | 2 |
| Mill finish (unquenched) | 180 | 18 | 5 |
| $H_3PO_4$ solution at 65° C. | 25 | 9 | 0 |
| $H_2SO_4$ solution at 65° C. | 61 | 32 | 0 |

To evaluate the effects of pretreatment (e.g., depositions) by reactive quenching, integrated XPS signals to 140 nm depths for zirconium were obtained. The integrated zirconium XPS signals for the control sample (DI water quench), the samples subjected to potassium hydroxide quench, the sample subjected to sulfuric acid quench, and the sample subjected to phosphoric acid quench all had integrated zirconium XPS signals less than those determined for the Ti/Zr quenched samples. The Ti/Zr quenched samples had integrated zirconium XPS signals of 30 and 10 for the 65° C. and ambient temperature solutions, respectively. The integrated zirconium XPS signals for the other samples ranged from 0 to 7. These results show that reactive quenching is useful for depositing material on (i.e., pretreating) the surface of an aluminum alloy product.

Illustrations

As used below, any reference to a series of illustrations is to be understood as a reference to each of those examples disjunctively (e.g., "Illustrations 1-4" is to be understood as "Illustrations 1, 2, 3, or 4").

Illustration 1 is a method of treating a metal, the method comprising: heating the metal to a first temperature; and exposing the metal to a solution, wherein exposing the metal to the solution cools the metal at a cooling rate of from about 100° C./s to about 10000° C./s (e.g., between about 300° C./s and about 2000° C./s), and wherein exposing the metal to the solution initiates a chemical reaction that modifies a surface of the metal.

Illustration 2 is a method of treating a metal, the method comprising: heating a metal to a first temperature; and exposing the metal to a solution comprising a reactive solute, wherein exposing the metal to the solution cools the metal at a cooling rate of from about 100° C./s to about 10000° C./s (e.g., from about 300° C./s to about 2000° C./s), wherein exposing the metal to the solution initiates a modification of a surface of the metal, optionally a chemical reaction involving the reactive solute that modifies the surface of the metal.

Illustration 3 is a method of treating a metal, the method comprising: heating a metal to a first temperature; and modifying a surface of the metal while cooling the metal by exposing the metal to a solution comprising a reactive solute, wherein exposing the metal to the solution: cools the metal at a cooling rate from about 100° C./s to about 10000° C./s; and initiates controlled modification of a surface of the metal, optionally a chemical reaction involving the reactive solute to perform controlled modification of the surface of the metal.

Illustration 4 is the method of any previous or subsequent illustration, further comprising selecting and establishing a process parameter, such as one or more of a solute or salt concentration in the solution, a flow rate for the solution, a pressure of the solution, a solution spray angle or geometry used during the exposing, a solution temperature, a time duration of the exposure of the metal to the solution or any combination of these, to control the cooling rate.

Illustration 5 is the method of any previous or subsequent illustration, further comprising selecting and establishing a process parameter, such as one or more of a concentration of the reactive solute in the solution, a temperature of the metal during the exposing, a temperature of the solution, a time duration of exposure of the metal to the solution, a flow rate of the solution during the exposing, a pressure of the solution, a solution spray angle or geometry used during the exposing, or any combination of these, to control a reaction rate of the chemical reaction.

Illustration 6 is the method of any previous or subsequent illustration, wherein the reactive solute is not water or is other than water.

Illustration 7 is the method of any previous or subsequent illustration, wherein water does not participate in the chemical reaction as a reactant.

Illustration 8 is the method of any previous or subsequent illustration, wherein the reactive solute is not a hydroxide salt or hydroxide ion or is other than a hydroxide salt or hydroxide ion.

Illustration 9 is the method of any previous or subsequent illustration, wherein hydroxide does not participate in the chemical reaction as a reactant.

Illustration 10 is the method of any previous or subsequent illustration, wherein the solution comprises water and one or more salts.

Illustration 11 is the method of any previous or subsequent illustration, wherein the one or more salts includes the reactive solute.

Illustration 12 is the method of any previous or subsequent illustration, wherein the one or more salts includes the reactive solute and one or more non-reactive or substantially non-reactive salts.

Illustration 13 is the method of any previous or subsequent illustration, wherein the solution comprises one or more alkali metal salts, alkaline earth metal salts, ammonium salts, sulfate salts, nitrate salts, borate salts, phosphate salts, acetate salts, or carbonate salts.

Illustration 14 is the method of any previous or subsequent illustration, wherein the solution comprises a salt concentration of between about 5 wt. % salt and about 30 wt. % salt.

Illustration 15 is the method of any previous or subsequent illustration, wherein the solution comprises a saturated or supersaturated salt solution.

Illustration 16 is the method of any previous or subsequent illustration, wherein the solution lacks or does not include halide ions or wherein a concentration of halogen ions in the solution is between 0 wt. % and 0.001 wt. %.

Illustration 17 is the method of any previous or subsequent illustration, wherein the solution comprises an aqueous alkaline solution.

Illustration 18 is the method of any previous or subsequent illustration, wherein the solution comprises one or more of sodium hydroxide, potassium hydroxide, ammonia, or ammonium ions.

Illustration 19 is the method of any previous or subsequent illustration, wherein the reactive solute comprises one or more of sodium hydroxide, potassium hydroxide, ammonia, or ammonium ions.

Illustration 20 is the method of any previous or subsequent illustration, wherein the solution comprises an aqueous acidic solution.

Illustration 21 is the method of any previous or subsequent illustration, wherein the solution comprises one or more of sulfuric acid, nitric acid, phosphoric acid, boric acid, or an organic acid.

Illustration 22 is the method of any previous or subsequent illustration, wherein the reactive solute comprises one or more of sulfuric acid, nitric acid, phosphoric acid, boric acid, or an organic acid.

Illustration 23 is the method of any previous or subsequent illustration, wherein the organic acid is a sulfonic acid or a carboxylic acid.

Illustration 24 is the method of any previous or subsequent illustration, wherein the solution comprises a thermally decomposable salt.

Illustration 25 is the method of any previous or subsequent illustration, wherein the reactive solute comprises a thermally decomposable salt.

Illustration 26 is the method of any previous or subsequent illustration, wherein the solution comprises one or more nitrate salts, nitrite salts, carbonate salts, hydrogen carbonate salts, phosphate salts, hydrogen phosphate salts, dihydrogen phosphate salts, or permanganate salts.

Illustration 27 is the method of any previous or subsequent illustration, wherein the reactive solute comprises one or more nitrate salts, nitrite salts, carbonate salts, hydrogen carbonate salts, phosphate salts, hydrogen phosphate salts, dihydrogen phosphate salts, or permanganate salts.

Illustration 28 is the method of any previous or subsequent illustration, wherein the solution comprises one or more chromium salts, copper salts, silver salts, or cerium salts.

Illustration 29 is the method of any previous or subsequent illustration, wherein the reactive solute comprises one or more chromium salts, copper salts, silver salts, or cerium salts.

Illustration 30 is the method of any previous or subsequent illustration, wherein the solution comprises one or more polymers, polymer precursors, or thermoset polymers.

Illustration 31 is the method of any previous or subsequent illustration, wherein the reactive solute comprises one or more polymers, polymer precursors, or thermoset polymers.

Illustration 32 is the method of any previous or subsequent illustration, wherein the solution comprises one or more gases, and wherein the reactive solute comprises a reactive gas.

Illustration 33 is the method of any previous or subsequent illustration, wherein the solution has a temperature of between 0° C. and 50° C.

Illustration 34 is the method of any previous or subsequent illustration, wherein the solution comprises insoluble particles.

Illustration 35 is the method of any previous or subsequent illustration, wherein exposing the metal to the solution compresses outer layers of the surface to form a compacted surface.

Illustration 36 is the method of any previous or subsequent illustration, wherein exposing the metal to the insoluble particles compresses outer layers of the surface to form a compacted surface.

Illustration 37 is the method of any previous or subsequent illustration, wherein exposing the metal to the solution erodes material from the surface to form an eroded surface.

Illustration 38 is the method of any previous or subsequent illustration, wherein exposing the metal to the insoluble particles erodes material from the surface to form an eroded surface.

Illustration 39 is the method of any previous or subsequent illustration, wherein the chemical reaction removes material from the surface of the metal.

Illustration 40 is the method of any previous or subsequent illustration, wherein the chemical reaction corresponds to cleaning, etching, or ablating the surface of the metal.

Illustration 41 is the method of any previous or subsequent illustration, wherein the chemical reaction deposits material on the surface of the metal.

Illustration 42 is the method of any previous or subsequent illustration, wherein the chemical reaction corresponds to forming a coating on the surface of the metal.

Illustration 43 is the method of any previous or subsequent illustration, wherein the chemical reaction corresponds to an acid etching reaction, an alkaline etching reaction, a thermal decomposition reaction, a polymerization reaction, an oxidative reaction, or a surface ablation.

Illustration 44 is the method of any previous or subsequent illustration, wherein the chemical reaction corresponds to an acid degradation of an oxide layer of the surface of the metal or an alkaline degradation of an oxide layer of the surface of the metal.

Illustration 45 is the method of any previous or subsequent illustration, wherein the chemical reaction includes removing or modifying an oxide layer of the surface of the metal to expose a metal surface layer, and wherein the chemical reaction further includes modifying the metal surface layer.

Illustration 46 is the method of any previous or subsequent illustration, wherein exposing the metal to the solution comprises immersing the metal in the solution, spraying the solution on the surface of the metal, or exposing the surface of the metal to a stream of the solution.

Illustration 47 is the method of any previous or subsequent illustration, wherein exposing the metal to the solution comprises exposing the metal to a plurality of different solutions.

Illustration 48 is the method of any previous or subsequent illustration, wherein exposing the metal to the solution includes cooling the metal to a series of increasingly lower temperatures.

Illustration 49 is the method of any previous or subsequent illustration, wherein exposing the metal to the solution includes cooling the metal at a decreasing cooling rate starting from a maximum cooling rate and ending at a minimum cooling rate.

Illustration 50 is the method of any previous or subsequent illustration, wherein exposing the metal to the solution comprises cooling the metal to a second temperature and wherein the method further comprises: exposing the metal to a second solution, wherein exposing the metal to the second solution cools the metal from the second temperature and initiates a second chemical reaction that further modifies the surface of the metal.

Illustration 51 is the method of any previous or subsequent illustration, wherein exposing the metal to the second solution cools the metal at a second cooling rate between 50° C./s and 500° C./s.

Illustration 52 is the method of any previous or subsequent illustration, wherein exposing the metal to the solution cools the metal to a second temperature between 25° C. and 500° C.

Illustration 53 is the method of any previous or subsequent illustration, wherein the first temperature is less than a melting temperature of the metal.

Illustration 54 is the method of any previous or subsequent illustration, wherein the first temperature is greater than or equal to a melting temperature of the metal.

Illustration 55 is the method of any previous or subsequent illustration, wherein the first temperature corresponds to a solution heat-treatment temperature or wherein heating the metal corresponds to solution heat-treating the metal.

Illustration 56 is the method of any previous or subsequent illustration, wherein cooling the metal includes fixing an alloying element concentration within a solid solution comprising the metal.

Illustration 57 is the method of any previous or subsequent illustration, wherein an alloying element concentration within a solid solution comprising the metal prior to heating is less than the alloying element concentration within the solid solution comprising the metal after exposing the metal to the solution comprising the reactive solute.

Illustration 58 is the method of any previous or subsequent illustration, wherein the metal has an alloying element distribution, and wherein the alloying element distribution prior to heating is less homogenous than the alloying element distribution after exposing the metal to the solution comprising the reactive solute.

Illustration 59 is the method of any previous or subsequent illustration, wherein the first temperature is between 500° C. and 1500° C.

Illustration 60 is the method of any previous or subsequent illustration, further comprising heat treating the metal by holding the metal at the first temperature for a period of time.

Illustration 61 is the method of any previous or subsequent illustration, wherein the metal comprises aluminum or an aluminum alloy, magnesium or a magnesium alloy, or steel.

Illustration 62 is the method of any previous or subsequent illustration, wherein the metal comprises a homogeneous alloy, a monolithic alloy, a metal alloy solid solution, a heterogeneous alloy, an intermetallic alloy, or a cladded alloy.

Illustration 63 is the method of any previous or subsequent illustration, wherein the metal comprises one or more elements selected from the group consisting of copper, manganese, magnesium, zinc, silicon, iron, chromium, tin, zirconium, lithium, and titanium.

Illustration 64 is the method of any previous or subsequent illustration, further comprising washing the surface of the metal with water after exposing the metal to the solution.

Illustration 65 is the method of any previous or subsequent illustration, further comprising anodizing the surface, powder coating the surface, or painting or printing on the surface.

Illustration 66 is a treated metal comprising a metal heated to a first temperature and exposed to a solution that cools the metal at a cooling rate of from about 100° C./s to about 10000° C./s (e.g., between about 300° C./s and about 2000° C./s) and initiates a chemical reaction that modifies a surface of the metal.

Illustration 67 is a treated metal comprising a metal heated to a first temperature and exposed to a solution comprising a reactive solute, wherein the solution cools the metal at a cooling rate of from about 100° C./s to about 2000° C./s (e.g., from about 300° C./s to about 2000° C./s) and initiates a chemical reaction involving the reactive solute, and wherein the chemical reaction modifies a surface of the metal.

Illustration 68 is a treated metal comprising a metal heated to a first temperature and subjected to a controlled surface modification while cooling by exposing the metal to a solution comprising a reactive solute, wherein exposing the metal to the solution: cools the metal at a cooling rate from about 100° C./s to about 10000° C./s; and initiates a chemical reaction involving the reactive solute to perform controlled modification of the surface of the metal.

Illustration 69 is the treated metal of any previous or subsequent illustration, wherein the chemical reaction that modifies the surface of the metal corresponds to a cleaning reaction, an etching reaction, an ablating reaction, a coating reaction, or a deposition reaction.

Illustration 70 is the treated metal of any previous or subsequent illustration, wherein the surface of the metal is cleaned, etched, ablated, coated, or deposited upon during the chemical reaction.

Illustration 71 is a treated metal formed by any of the methods of any previous illustrations.

All patents, publications and abstracts cited above are incorporated herein by reference in their entirety. The foregoing description of the embodiments, including illustrated embodiments, has been presented only for the purpose of illustration and description and is not intended to be exhaustive or limiting to the precise forms disclosed. Numerous modifications, adaptations, and uses thereof will be apparent to those skilled in the art.

What is claimed is:

1. A method of treating a metal, the method comprising:

heating a metal to a first temperature of from 500° C. to 1500° C.; and exposing the metal to a solution comprising a reactive solute, wherein exposing the metal to the solution cools the metal at a cooling rate of from about 300° C./s to about 2000° C./s, wherein exposing the metal to the solution initiates a chemical reaction involving the reactive solute, and wherein the chemical reaction modifies a surface of the metal.

2. The method of claim 1, wherein the solution comprises water and one or more salts.

3. The method of claim 1, wherein the solution comprises one or more alkali metal salts, alkaline earth metal salts, ammonium salts, sulfate salts, nitrate salts, borate salts, phosphate salts, acetate salts, or carbonate salts.

4. The method of claim 1, wherein the solution comprises a salt concentration of from about 5 wt. % salt to about 30 wt. % salt.

5. The method of claim 1, wherein the solution comprises an aqueous alkaline solution.

6. The method of claim 1, wherein the reactive solute comprises one or more of sodium hydroxide, potassium hydroxide, ammonia, or ammonium ions.

7. The method of claim 1, wherein the solution comprises an aqueous acidic solution.

8. The method of claim 1, wherein the reactive solute comprises one or more of sulfuric acid, nitric acid, phosphoric acid, boric acid, or an organic acid.

9. The method of claim 1, wherein the reactive solute comprises a thermally decomposable salt.

10. The method of claim 1, wherein the reactive solute comprises one or more nitrate salts, nitrite salts, carbonate salts, hydrogen carbonate salts, phosphate salts, hydrogen phosphate salts, dihydrogen phosphate salts, or permanganate salts.

11. The method of claim 1, wherein the reactive solute comprises one or more chromium salts, copper salts, silver salts, or cerium salts.

12. The method of claim 1, wherein the reactive solute comprises one or more polymers, polymer precursors, or thermoset polymers.

13. The method of claim 1, wherein the chemical reaction removes material from the surface of the metal.

14. The method of claim 1, wherein the chemical reaction corresponds to cleaning, etching, or ablating the surface of the metal.

15. The method of claim 1, wherein the chemical reaction deposits material on the surface of the metal or forms a coating on the surface of the metal.

16. The method of claim 1, wherein the chemical reaction corresponds to an acid etching reaction, an alkaline etching reaction, a thermal decomposition reaction, a polymerization reaction, an oxidative reaction, or a surface ablation.

17. The method of claim 1, wherein exposing the metal to the solution comprises exposing the metal to a plurality of different solutions.

18. The method of claim 1, wherein the metal comprises an aluminum alloy.

* * * * *